US006337176B1

(12) United States Patent
Matsumoto et al.

(10) Patent No.: US 6,337,176 B1
(45) Date of Patent: Jan. 8, 2002

(54) SILVER HALIDE COLOR PHOTOGRAPHIC LIGHTSENSITIVE MATERIAL

(75) Inventors: Keisuke Matsumoto; Takayuki Ito, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/675,008

(22) Filed: Sep. 29, 2000

(30) Foreign Application Priority Data

Sep. 29, 1999 (JP) ..... 11-276338

(51) Int. Cl.[7] ..... G03C 7/333; G03C 7/18

(52) U.S. Cl. ..... 430/504; 430/359; 430/226; 430/549

(58) Field of Search ..... 430/359, 504, 430/549, 226

(56) References Cited

U.S. PATENT DOCUMENTS 2,449,966 A * 9/1948 Hanson ..... 430/359
4,749,641 A * 6/1988 Kaufman et al. ..... 430/359
4,952,490 A 8/1990 Takada et al. ..... 430/567
5,264,337 A 11/1993 Maskasky ..... 430/567
5,356,764 A 10/1994 Szajewski et al. ..... 430/567
5,399,468 A 3/1995 Sawyer et al. ..... 430/359

FOREIGN PATENT DOCUMENTS

WO WO9422051 9/1994

* cited by examiner

*Primary Examiner*—Richard L. Schilling
(74) *Attorney, Agent, or Firm*—Birch, Stewart, Kolasch & Birch, LLP

(57) ABSTRACT

A silver halide color photographic lightsensitive material comprising a support and, superimposed thereon, at least one red-sensitive silver halide emulsion layer, at least one green-sensitive silver halide emulsion layer and at least one blue-sensitive silver halide emulsion layer, wherein each of the at least one red-sensitive emulsion layer, at least one green-sensitive emulsion layer and at least one blue-sensitive emulsion layer contains a silver halide emulsion whose silver chloride content is in the range of 50 to 100 mol %, and at least one layer of the lightsensitive material contains a compound represented by formula:

$$Cp—(L)_n—B \quad (I).$$

12 Claims, No Drawings

SILVER HALIDE COLOR PHOTOGRAPHIC LIGHTSENSITIVE MATERIAL

CROSS-REFERENCE TO RELATED APPLICATIONS

This application is based upon and claims the benefit of priority from the prior Japanese Patent Application No. 11-276338, filed Sep. 29, 1999, the entire contents of which are incorporated herein by reference.

BACKGROUND OF THE INVENTION

The present invention relates to a silver halide color photographic lightsensitive material which can be rapidly processed and which has been improved with respect to color reproduction and sharpness with the use of a colored coupler.

Among the silver halide color photographic lightsensitive materials, photographic film lightsensitive materials for use in photographing (hereinafter also referred to as "films") have silver coating amounts greater than those of print materials (hereinafter also referred to as "prints"), so that the loads on development and desilvering steps are heavy to thereby generally prolong the development processing time.

On the other hand, in accordance with the recent scattering of color laboratory (development location), the number of city photograph shops and other small-scale color laboratories, called "minilaboratories", which carry out development processing (hereinafter simply referred to as "processing") at shops is increasing, and there is a conspicuous trend for the shop processing performed at minilaboratories to replace the conventional processing that presupposes collection and delivery. At the shop processing, it is especially an important task to shorten the appointed period for completion, and, above all, it is desired to shorten the film processing time including that for development.

In order to provide means for shortening the film processing time, films carrying a high-silver chloride emulsion wherein the silver halide is mainly composed of silver chloride have been disclosed as replacement for the conventional films carrying a high-silver bromide emulsion wherein the silver halide is mainly composed of silver bromide. The former emulsion exhibits a high reaction rate at the time of development and is substantially free from the release of iodide ions which are inhibitory in fixing operation as compared with the latter emulsion, so that the former emulsion could be stated as being excellent in respect of the attainment of rapid processing and the reduction of replenisher quantity. As an example of such high-silver chloride emulsions, there can be mentioned the disclosure of a technology using a high-silver chloride emulsion having the (111) faces in Jpn. Pat. Appln. KOKAI Publication No. (hereinafter referred to as JP-A-) 63-212932. Further, there can be mentioned the disclosure of a tabular emulsion having the (100) faces in U.S. Pat. No. 5,264,337.

Apart from the above, in recent years, there is an increasing demand for the enhancement of image quality in, for example, color reproduction and sharpness with respect to lightsensitive materials. Thus, a lightsensitive material free from the deterioration of image quality even under shortened processing time conditions is now demanded. As a means for enhancing the image quality, there is known, for example, the releasing of photographically useful compounds such as a development inhibitor during development processing. However, when the processing time is short, there is no sufficient time for the released compound to fully exert its effect. Accordingly, the contribution thereof to the enhancement of image quality would not be satisfactory.

Attempts for enhancing the image quality in the use of high-silver chloride emulsions have been made. For example, the method of adding DIR compounds is described in U.S. Pat. No. 5,356,764. Further, the method of adding compounds capable of releasing photographically useful compounds at the time of development is described in International Patent Publication 94/22051. Some image quality enhancement can be attained by these methods. However, they can never be stated as being satisfactory.

On the other hand, the method of enhancing the image quality of color photographic lightsensitive material with the use of magenta colored yellow couplers is described in, for example, U.S. Pat. No. 5,399,468. This method, although providing a means for enhancing the image quality, has not been one which attains such a conspicuous image quality enhancement as cannot be anticipated from the enhancement by the use of DIR compounds.

As apparent from the above, it has been difficult to realize rapid processing while ensuring a high image quality by the employment of conventional technology.

BRIEF SUMMARY OF THE INVENTION

Therefore, an object of the present invention is to provide a silver halide color photographic lightsensitive material which can be processed within a short period of time, and, irrespective of the shortened processing, realizes satisfactorily enhanced color reproduction and sharpness.

The above object can be attained by the following silver halide color photographic lightsensitive material.

(1) A silver halide color photographic lightsensitive material comprising a support and, superimposed thereon, at least one red-sensitive silver halide emulsion layer, at least one green-sensitive silver halide emulsion layer and at least one blue-sensitive silver halide emulsion layer, wherein each of the at least one red-sensitive emulsion layer, the at least one green-sensitive emulsion layer, and the at least one blue-sensitive emulsion layer contains a silver halide emulsion whose silver chloride content is in the range of 50 to 100 mol % and wherein at least one of the silver halide emulsion layers contains a compound of the general formula (I):

$$\mathrm{Cp}\text{—}(\mathrm{L})_n\text{—}\mathrm{B} \qquad \text{(I)}$$

wherein Cp represents a yellow coupler residue capable of reacting with a developing agent in an oxidized form to thereby release —$(L)_n$—B; L represents a divalent connecting group or timing group; B represents a group required to form magenta image in the form of Cp—$(L)_n$—B at least after development, while the released —$(L)_n$—B group substantially does not contribute to any image formation after development; and n is 0 or 1.

(2) The silver halide color photographic lightsensitive material as recited in item (1) above, wherein the yellow coupler residue Cp is represented by formula (I-A) or (I-B):

(I-A)

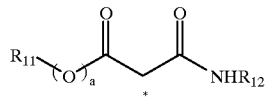

wherein, * represents a position at which the yellow coupler residue Cp is bonded to —$(L)_n$—B of the general formula (I); $R_{11}$ represents an alkyl group, an alkenyl group, an alkynyl group, an aryl group or a heterocyclic group; $R_{12}$ represents a hydrogen atom, an alkyl group, an alkenyl group, an alkynyl group, an aryl group or a heterocyclic group; and a is 0 or 1, (I-B)

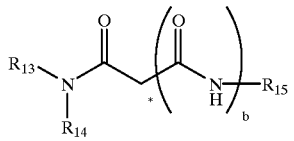

wherein * represents a position at which the yellow coupler residue Cp is bonded to —$(L)_n$—B of the general formula (I); $R_{13}$ represents an alkyl group, an alkenyl group, an alkynyl group, an aryl group or a heterocyclic group; each of $R_{14}$ and $R_{15}$ independently represents a hydrogen atom, an alkyl group, an alkenyl group, an alkynyl group, an aryl group or a heterocyclic group; and b is 0 or 1.

(3) The silver halide color photographic lightsensitive material as recited in item (2) above, wherein the yellow coupler residue Cp represented by formula (1-A) is represented by formula (I-C):

(I-C)

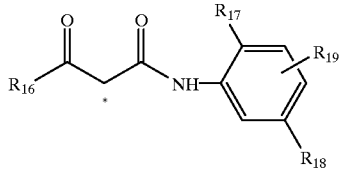

wherein * represents a position at which the yellow coupler residue Cp is bonded to —$(L)_n$—B of the general formula (I); $R_{16}$ represents a tertiary alkyl group, an aryl group or an indolinyl group; $R_{17}$ represents a halogen atom, an alkoxy group, an aryloxy group or an alkyl group; $R_{18}$ represents an acylamino group, a sulfonamido group, a carbamoyl group, a sulfamoyl group, an alkoxycarbonyl group or a sulfonyl group; and $R_{19}$ represents a hydrogen atom or a substituent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

The lightsensitive material of the present invention contains the compound represented by the general formula (I):

$$Cp—(L)_n—B \quad (I)$$

wherein Cp represents a yellow coupler residue capable of reacting with a developing agent in an oxidized form to thereby release —$(L)_n$—B; L represents a divalent connecting group or timing group; B represents a group needed to form magenta image in the form of Cp—$(L)_n$—B at least after development, while the released —$(L)_n$—B group substantially does not contribute to any image formation after development; and n is 0 or 1.

The coupler represented by the general formula (I) will now be described in detail.

Cp represents a yellow coupler residue capable of reacting with a developing agent in an oxidized form to thereby release —$(L)_n$—B. The coupler residue represented by Cp can be, for example, any of pivaloylacetanilido residues, benzoylacetanilido residues, malondiester residues, malondiamido residues, dibenzoylmethane residues, benzothiazolylacetamido residues, malonestermonoamido residues, benzoxazolylacetamido residues, benzoylimidazolylacetamido residues, cycloalkanoylacetamido residues, indolin-2-ylacetamido residues, quinazolin-4-on-2-ylacetamido residues described in U.S. Pat. No. 5,021,332, the disclosure of which is incorporated herewith by reference, benzo-1,2,4-thiadiazine-1,1-dioxido-3-ylacetamido residues described in U.S. Pat. No. 5,021,330, the disclosure of which is incorporated herewith by reference, coupler residues described in EP No. 421221A, the disclosure of which is incorporated herewith by reference, coupler residues described in U.S. Pat. No. 5,455,149, the disclosure of which is incorporated herewith by reference, coupler residues described in EP No. 622673A, the disclosure of which is incorporated herewith by reference, and coupler residues described in JP-A-10-148921 the disclosure of which is incorporated herewith by reference. It is preferred that Cp have a nondiffusing group.

Cp is preferably represented by the following general formula (I-A) or (I-B), more preferably by the following general formula (I-C).

(I-A)

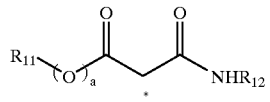

(I-B)

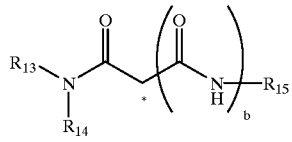

(I-C)

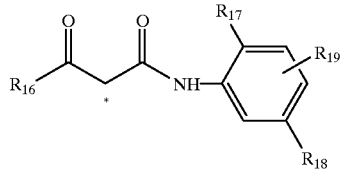

In the formulae, $R_{11}$ represents an alkyl group, an alkenyl group, an alkynyl group, an aryl group or a heterocyclic group.

The alkyl group represented by $R_{11}$ is preferably a substituted or unsubstituted alkyl group including a cycloalkyl group, having 1 to 32 carbon atoms, more preferably 1 to 22 carbon atoms, which may be cyclic, which is, for example, methyl, ethyl, propyl, isopropyl, butyl, isobutyl, t-butyl, t-amyl, hexyl, cyclohexyl, 2-ethylhexyl, octyl, 1,1,3,3-tetramethylbutyl, decyl, dodecyl, hexadecyl or octadecyl. The alkenyl or alkynyl group represented by $R_{11}$ is preferably a substituted or unsubstituted alkenyl or alkynyl group having 2 to 32 carbon atoms, more preferably 2 to 22 carbon atoms, which may be cyclic. Examples thereof include vinyl, 2-propenyl, ethynyl and 2-propynyl. The terminology "carbon atoms" used herein means the total number of carbon atoms which, when the alkyl, alkenyl or alkynyl group has a substituent, includes the number of carbon atoms of the substituent. With respect to the groups other than the alkyl, alkenyl and alkynyl groups as well, the total number of carbon atoms including that of any substituent thereof is meant.

The aryl group represented by $R_{11}$ is preferably a substituted or unsubstituted aryl group having 6 to 40 carbon atoms, more preferably 6 to 30 carbon atoms, which is, for example, phenyl, tolyl or naphthyl.

The heterocyclic group represented by $R_{11}$ is preferably a substituted or unsubstituted 3- to 8-membered heterocyclic group, whose hetero atom is selected from the group consisting of nitrogen atom, oxygen atom and sulfur atom, having 1 to 40 carbon atoms, more preferably 1 to 30 carbon atoms, to which an aromatic carbon ring such as benzene may be condensed, which is, for example, 2-furyl, 2-pyrrolyl, 2-thienyl, 3-tetrahydrofuranyl, 4-pyridyl, 2-pyrimidinyl, 2-(1,3,4-thiadiazolyl), 2-benzothiazolyl, 2-benzoxazolyl, 2-benzimidazolyl, 2-benzoselenazolyl, 2-quinolyl, 2-oxazolyl, 2-thiazolyl, 2-selenazolyl, 5-tetrazolyl, 2-(1,3,4-oxadiazolyl) or 2-imidazolyl.

The substituents suitable to the above or below mentioned groups and the below mentioned substituents include, for example, halogen atoms (for example, fluorine, chlorine, bromine and iodine atoms), a hydroxyl group, a carboxyl group, a sulfo group, a cyano group, a nitro group, alkyl groups (for example, methyl, ethyl and hexyl), fluoroalkyl groups (for example, trifluoromethyl), aryl groups (for example, phenyl, tolyl and naphthyl), heterocyclic groups (for example, heterocyclic groups mentioned with respect to $R_{11}$), alkoxy groups (for example, methoxy, ethoxy and octyloxy), aryloxy groups (for example, phenoxy and naphthyloxy), alkylthio groups (for example, methylthio and butylthio), arylthio groups (for example, phenylthio), amino groups (for example, amino, N-methylamino, N,N-dimethylamino and N-phenylamino), acyl groups (for example, acetyl, propionyl and benzoyl), alkyl- or arylsulfonyl groups (for example, methylsulfonyl and phenylsulfonyl), acylamino groups (for example, acetylamino and benzoylamino), alkyl- or arylsulfonylamino groups (for example, methanesulfonylamino and benzenesulfonylamino), carbamoyl groups (for example, carbamoyl, N-methylamincarbonyl, N,N-dimethylaminocarbonyl and N-phenylaminocarbonyl), sulfamoyl groups (for example, sulfamoyl, N-methylaminosulfonyl, N,N-dimethylaminosulfonyl and N-phenylaminosulfonyl), alkoxycarbonyl groups (for example, methoxycarbonyl, ethoxycarbonyl and octyloxycarbonyl), aryloxycarbonyl groups (for example, phenoxycarbonyl and naphthyloxycarbonyl), acyloxy groups (for example, acetyloxy and benzoyloxy), alkoxycarbonyloxy groups (for example, methoxycarbonyloxy and ethoxycarbonyloxy), aryloxycarbonyloxy groups (for example, phenoxycarbonyloxy), alkoxycarbonylamino groups (for example, methoxycarbonylamino and butoxycarbonylamino), aryloxycarbonylamino groups (for example, phenoxycarbonylamino), aminocarbonyloxy groups (for example, N-methylaminocarbonyloxy and N-phenylaminocarbonyloxy) and aminocarbonylamino groups (for example, N-methylaminocarbonylamino and N-phenylaminocarbonylamino).

$R_{12}$ represents a hydrogen atom, an alkyl group, an alkenyl group, an alkynyl group, an aryl group or a heterocyclic group. The alkyl group, alkenyl group, alkynyl group, aryl group and heterocyclic group represented by $R_{12}$ are the same as set forth above with respect to $R_{11}$. It is preferred that $R_{12}$ represent an aryl group. a is 0 or 1.

When a=1, $R_{11}$ is preferably an alkyl group. When a=0, $R_{11}$ is preferably an alkyl group or an aryl group.

$R_{13}$ represents an alkyl group, an alkenyl group, an alkynyl group, an aryl group or a heterocyclic group. Each of $R_{14}$ and $R_{15}$ independently represents a hydrogen atom, an alkyl group, an alkenyl group, an alkynyl group, an aryl group or a heterocyclic group. $R_{13}$ and $R_{14}$ may combine with each other to form a ring. The alkyl group, alkenyl group, alkynyl group, aryl group and heterocyclic group represented by $R_{13}$, $R_{14}$ and $R_{15}$ are the same as set forth above with respect to $R_{11}$. b is 0 or 1. When b is 0, it is preferred that $R_{15}$, $R_{13}$ and $R_{14}$ represent a heterocyclic group, an aryl group and a hydrogen atom, respectively. When b is 1, it is preferred that $R_{15}$ and $R_{13}$ simultaneously represent an aryl group and that $R_{14}$ represent an alkyl group, an alkenyl group or a hydrogen atom. When $R_{13}$ represents an aryl group while $R_{14}$ represents an alkyl or alkenyl group, it is preferred that $R_{13}$ and $R_{14}$ be bonded with each other to thereby form preferably a 3- to 8-membered, more preferably a 5-membered ring, to which an aromatic ring, for example, a benzene ring is condensed.

$R_{16}$ represents a tertiary alkyl group (substituted or unsubstituted tertiary alkyl group having 4 to 20 carbon atoms, for example, an acyclic tertiary alkyl group such as t-butyl, 1,1-dimethylpropyl, 1,1-dimethylhexyl, 1,1-dimethyl-2-methoxyethyl or 1,1-dimethyl-2-phenylethyl, or a cycloalkyl group such as 1-methylcyclopropyl, 1-ethylcyclopropyl, 1-benzylcyclopropyl, 1-methylcyclobutyl, 1-methylcyclopentyl, 1-ethylcyclopentyl, 1-methylcyclohexyl, 5-methyl-1,3-dioxan-5-yl, 2,2,5-trimethyl-1,3-dioxan-5-yl or 1-adamantyl), an aryl group (substituted or unsubstituted aryl group having 6 to 24 carbon atoms, for example, phenyl, 2-methylphenyl, 4-methoxyphenyl, 4-hexadecyloxyphenyl, 3-chlorophenyl, 3,5-dimethylphenyl or 2-naphthyl) or an indolinyl group (substituted or unsubstituted indolinyl group, for example, indolinyl, 2-methylindolinyl, 5-chloroindolinyl or 5-cyanoindolinyl).

$R_{17}$ represents a halogen atom (for example, a fluorine atom, a bromine atom or a chlorine atom), an alkoxy group (substituted or unsubstituted alkoxy group having preferably 1 to 24 carbon atoms, for example, methoxy, ethoxy, butoxy, octyloxy, cyclohexyloxy, n-dodecyloxy, n-hexadecyloxy or methoxyehtoxy), an aryloxy group (substituted or unsubstituted aryloxy group having preferably 6 to 24-carbon atoms, for example, phenoxy, 4-methylphenoxy, 4-methoxyphenoxy, 2-chlorophenoxy or 1-naphthyloxy) or an alkyl group (substituted or unsubstituted alkyl group having preferably 1 to 24 carbon atoms, for example, methyl, butyl, isopropyl or t-butyl).

$R_{18}$ represents an acylamino group (substituted or unsubstituted acylamino group having preferably 1 to 24 carbon atoms, for example, acetylamino, benzoylamino, stearoylamino, N-methylstearoylamino or 2-(2,4-di-t-amylphenoxy)butyrylamino), a sulfonamido group (substituted or unsubstituted sulfonamido group having preferably 1 to 24 carbon atoms, for example, methanesulfonamido, butanesulfonamido, dodecanesulfonamido, hexadecanesulfonamido or benzenesulfonamido), a carbamoyl group (substituted or unsubstituted carbamoyl group having preferably, 1 to 36 carbon atoms, for example, N,N-diethylcarbamoyl, N,N-dioctylcarbamoyl, N-methyl-N-hexadecylcarbamoyl or N-phenyl-N-dodecylcarbamoyl), a sulfamoyl group (substituted or unsubstituted sulfamoyl group having preferably, 1 to 36 carbon atoms, for example, N,N-diethylsulfamoyl, N,N-dioctylsulfamoyl, N-methyl-N-hexadecylsulfamoyl or N-phenyl-N-dodecylsulfamoyl), an alkoxycarbonyl group (substituted or unsubstituted alkoxycarbonyl group having preferably, 1 to 24 carbon atoms, for example, methoxycarbonyl or dodecyloxycarbonyl) or a sulfonyl group (substituted or unsubstituted sulfonyl group having preferably, 1 to 24 carbon atoms, for example, methanesulfonyl, dodecanesulfonyl or octadecanesulfonyl).

$R_{19}$ represents a hydrogen atom or a substituent.

L represents a divalent connecting group or timing group. L is capable of splitting off from Cp in the form of —$(L)_n$—B. That is, L is used to regulate the reaction between the coupler represented by the general formula (I) and a developing agent in an oxidized form. The group represented by L can be any of those generally known as coupling split-off groups or those generally known as timing groups. Examples of the coupling split-off groups include aryloxy groups, arylthio groups, alkylthio groups, alkyl- or arylcarbonyloxy groups, alkyl- or aryloxycarbonyloxy groups, aminocarbonyloxy groups and nitrogenous heterocyclic groups capable of bonding with Cp at its nitrogen atom (for example, 1-pyrazolyl, 1,2,4-triazol-1(or 4)-yl, 1-imidazolyl, 1-benzotriazolyl, 1-benzoimidazolyl, imidazolidine-2,4-dion-3-yl, oxazolidine-2,4-dion-3-yl, 1,2,4-triazolidine-3,5-dion-4-yl, phthalimide and succinimide). Each of these groups represented by L can be bonded with B at a substitutable position thereof, and may possess substituents other than B. When L represents a timing group, the bond between L and B can be cleaved after being split off from Cp in the form of —$(L)_n$—B. Examples of such timing groups include groups capable of inducing a cleavage reaction with the use of intramolecular nucleophilic substitution reaction as described in U.S. Pat. No. 4,248,962, the disclosure of which is incorporated herewith by reference, groups capable of inducing cleavage with the use of electron transfer reaction as described in U.S. Pat. Nos. 4,409,323 and 4,421,845, the disclosures of which are incorporated herewith by reference, and groups capable of inducing cleavage with the use of hydrolysis reaction of ester as described in DE No. 2,626,317 the disclosure of which is incorporated herewith by reference.

Examples of the timing group are set forth below, however, the present invention is not limited to these. In the following groups, * represents the side that is combined to Cp and ** represents the side that is combined to B.

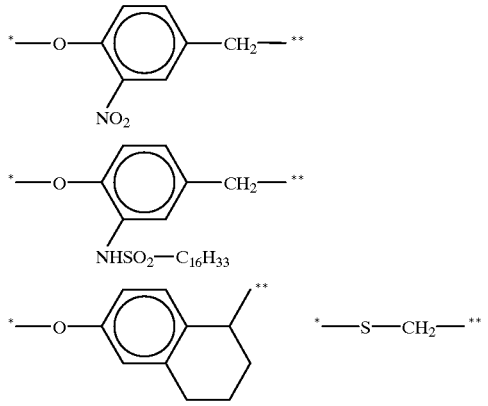

-continued

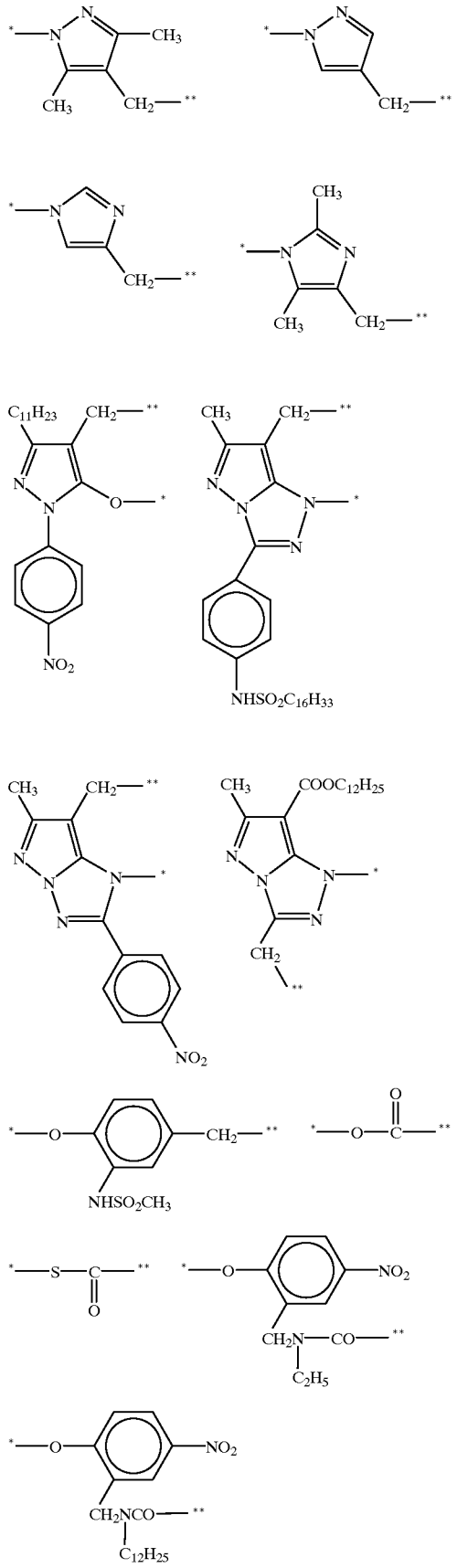

-continued

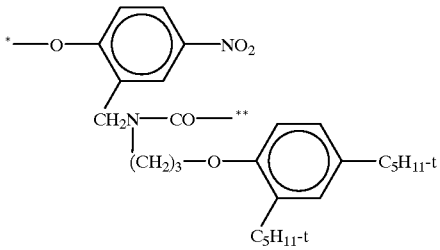

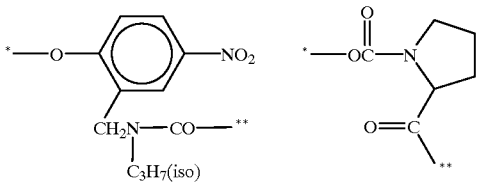

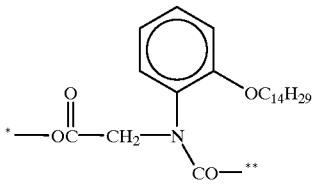

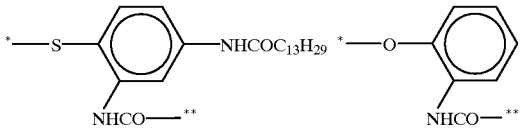

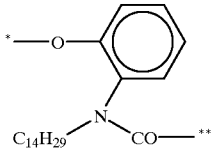

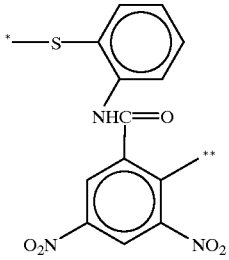

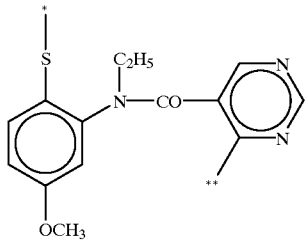

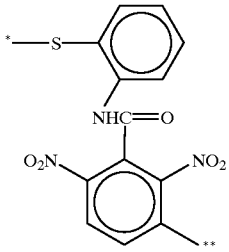

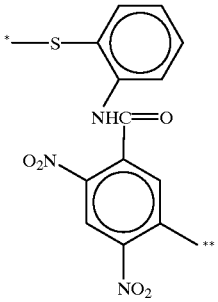

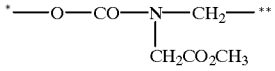

-continued

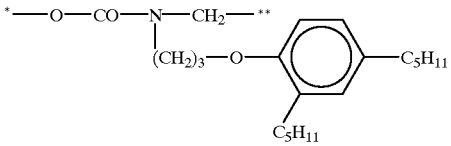

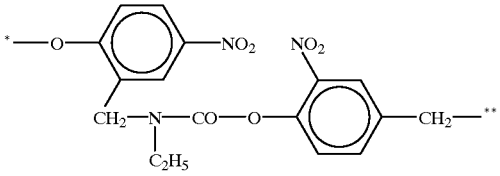

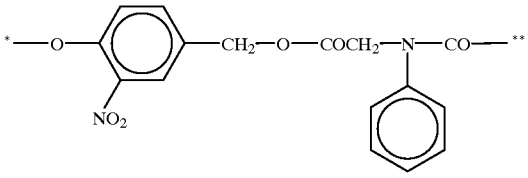

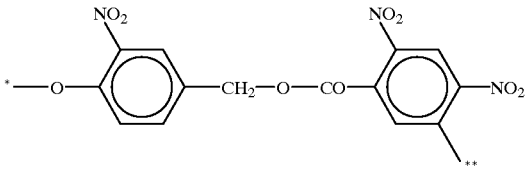

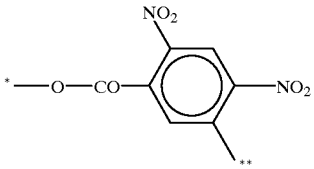

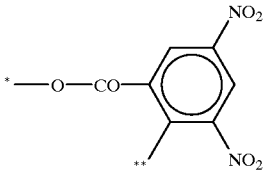

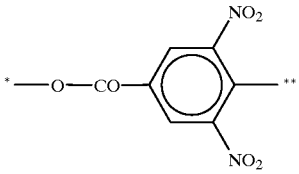

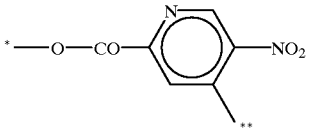

B represents a group required to form magenta image in the form of Cp—$(L)_n$—B at least after the development, in the process comprising a step of exposuring the lightsensitive material of the invention to light, followed by a step of development and a step of forming images, at an unexposed portion of the material, while —$(L)_n$—B released by a coupling reaction substantially does not contribute to any image formation after the development, at an exposed portion of the material.

In order to form magenta image in the form of Cp—$(L)_n$—B after development, B may be either a magenta dye residue exhibiting main absorption in the 500 to 600 nm green ray region, or a magenta dye precursor capable of forming a magenta dye during development. Further, from the viewpoint that the —$(L)_n$—B released by a coupling reaction substantially does not contribute to any image formation after development, it is preferred that the —$(L)_n$—B be easily dissolved into the processing solution, namely water-soluble.

As the magenta dye residue represented by B, use can be made of known water-soluble dyes (for example, oxonol dyes, hemioxonol dyes, styryl dyes, merocyanine dyes, cyanine dyes, azo dyes, azomethine dyes, anthraquinone dyes and benzylidene dyes). Specific examples of these dyes are described in, for example, GB Nos. 584,609, and 1,177,429, JP-A's-48-85130, 49-99620, 49-114420, and 52-108115, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352, the disclosures of which are incorporated herein by reference. Also, specific examples of the dyes are described in "Dye Manual New Edition" edited by the Organic Synthetic Chemistry Association and published by Maruzen Co., Ltd., the disclosure of which is incorporated herewith by reference, and other publications.

Examples of the magenta dye precursors represented by B include those wherein the auxochrome is protected by a protective group and the protection is eliminated by the action of a nucleophilic agent or silver ions contained in the processing solution to thereby provide a magenta dye, as described in, for example, JP-A-62-145243, EP No. 516830, EP No. 326160, Japanese Patent Nos. 2,515,153, and 2,724,353 and U.S. Pat. No. 5,364,745, the disclosures of which are incorporated herein by reference; those capable of coordinating with metal ions contained in the processing solution to thereby provide a magenta dye, as described in U.S. Pat. No. 4,555,478, EP No. 186869 and JP-A-2-96157, the disclosures of which are incorporated herein by reference; and those capable of reacting with the developing agent contained in the processing solution to thereby provide a magenta dye, as described in JP-A-2-105144, the disclosure of which is incorporated herewith by reference.

The couplers represented by the general formula (I) can be easily synthesized by known methods with reference to the above indicated patent publications and literature cited therein.

Specific examples of the couplers of the general formula (I) are shown below, which are however not limiting.

(1)

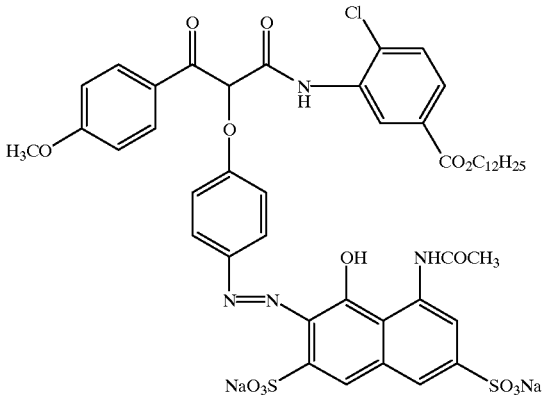

(2)

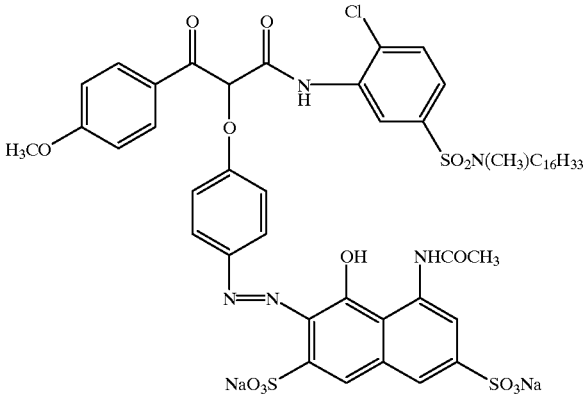

-continued
(3)
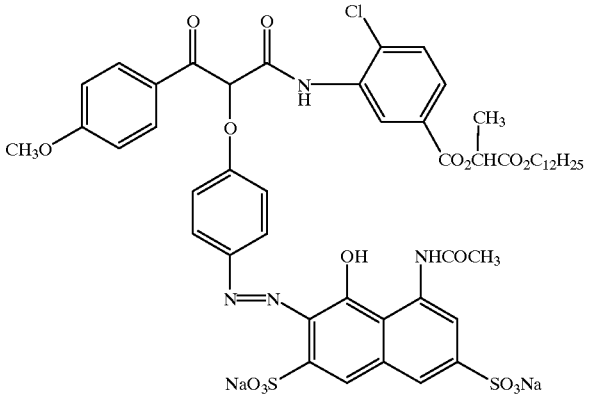
(4)
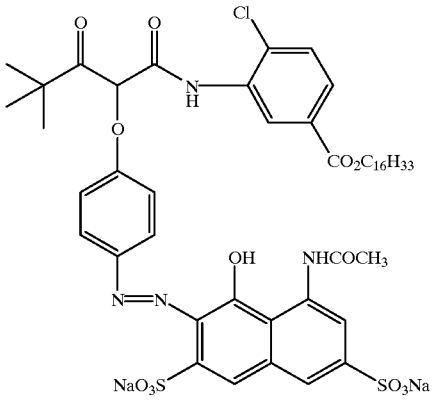
(5)
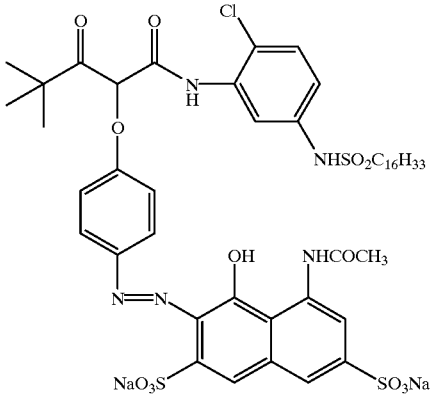

-continued
(6)
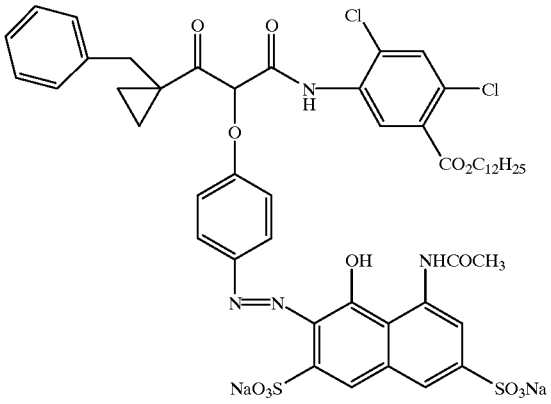
(7)
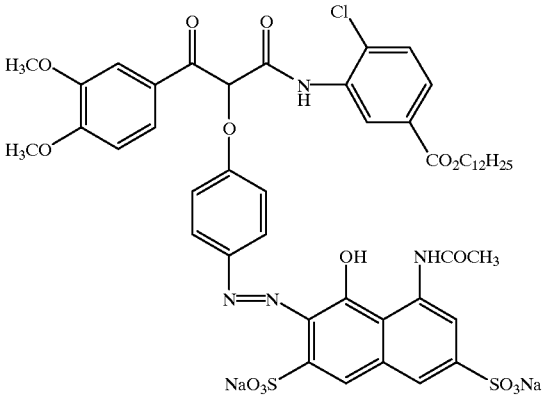
(8)
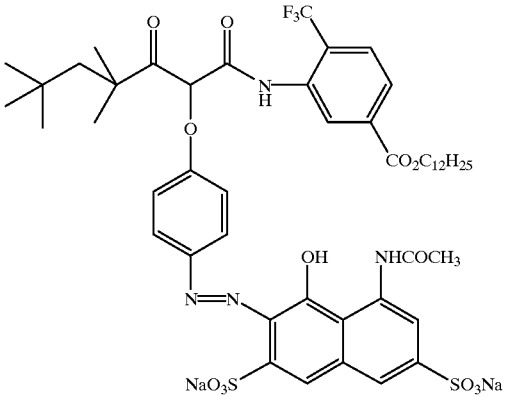

-continued
(9)
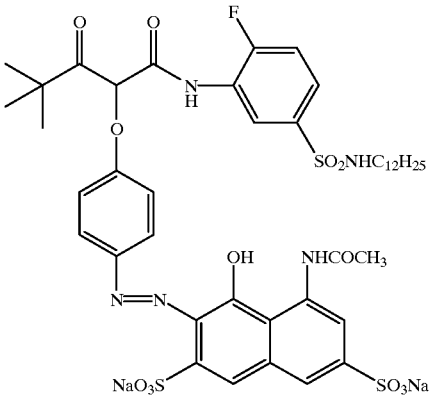
(10)
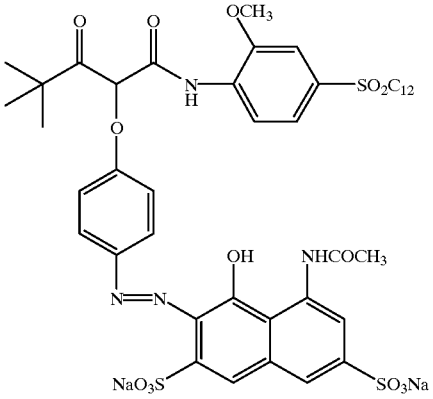
(11)
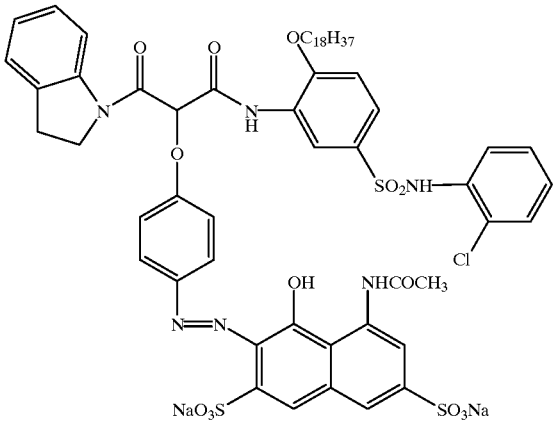

-continued
(12)
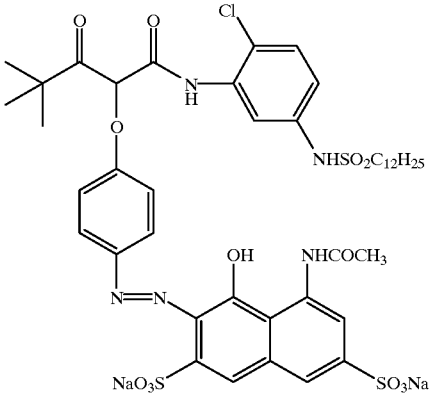
(13)
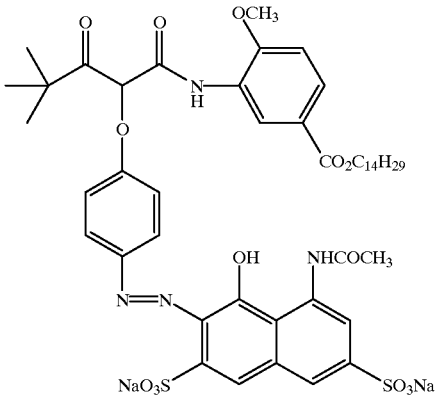
(14)
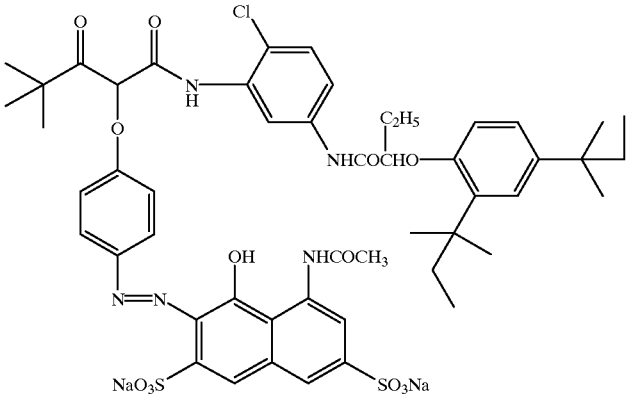

-continued
(15)
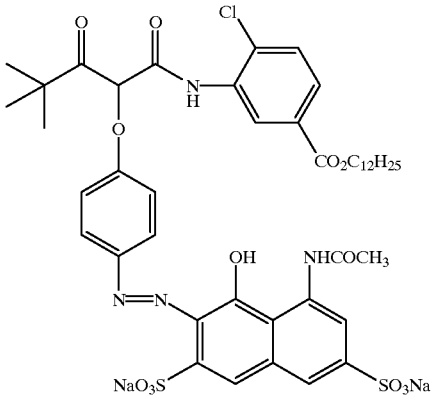
(16)
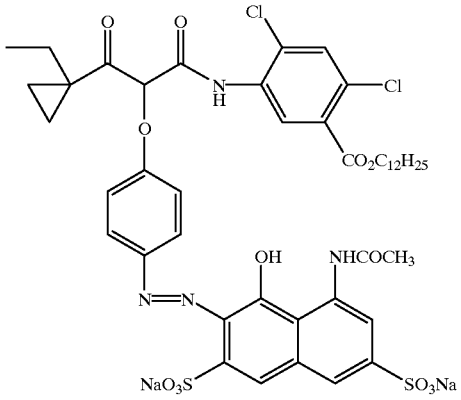
(17)
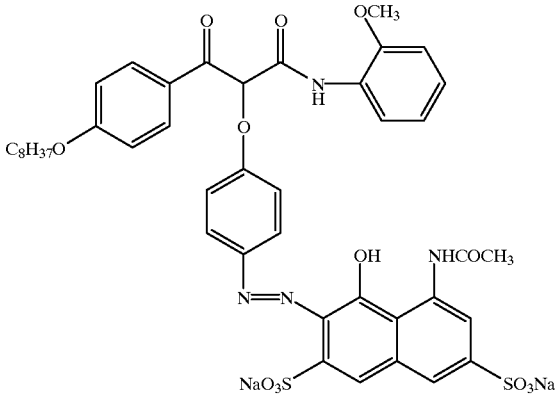

-continued
(18)
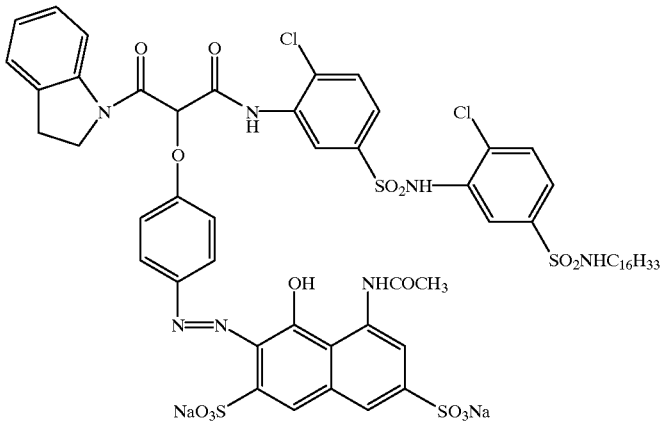
(19)
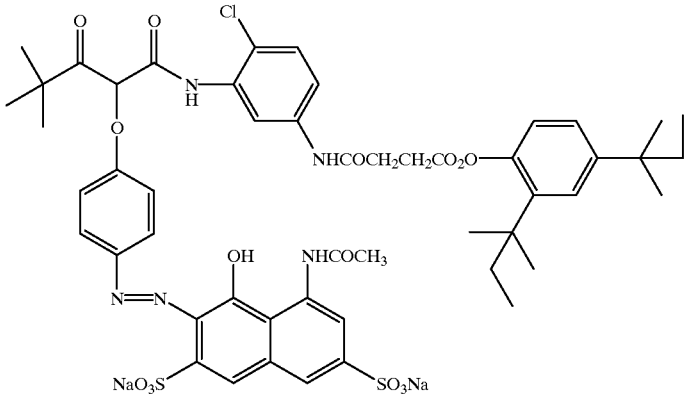
(20)
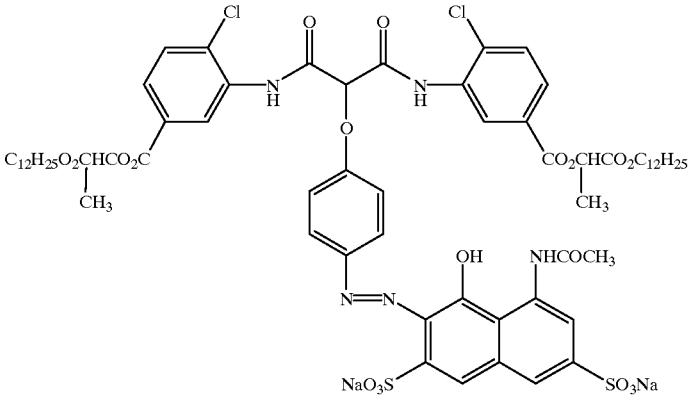

-continued
(21)
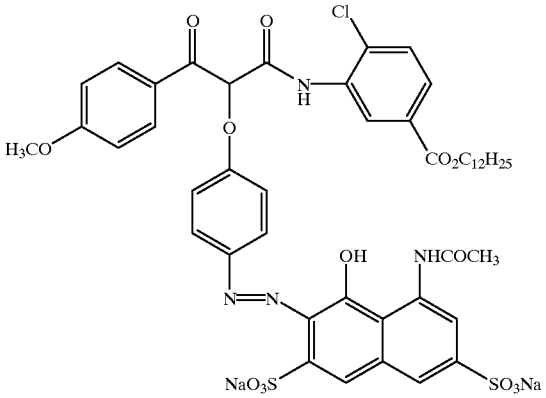
(22)
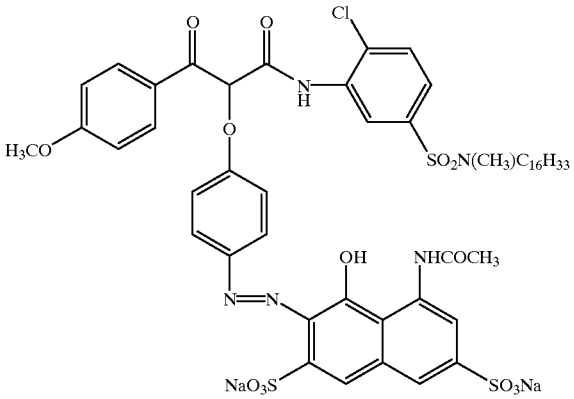
(23)
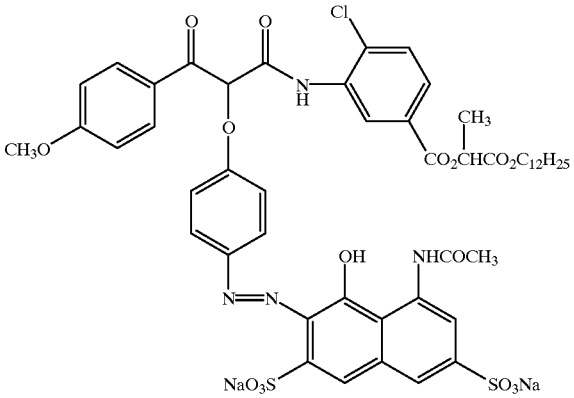
(24)
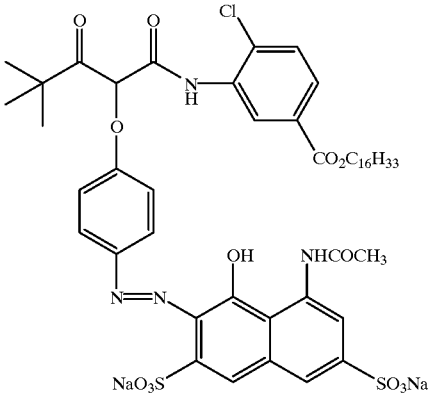

-continued
(25)
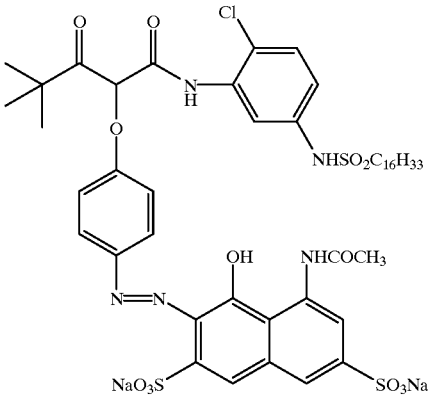
(26)
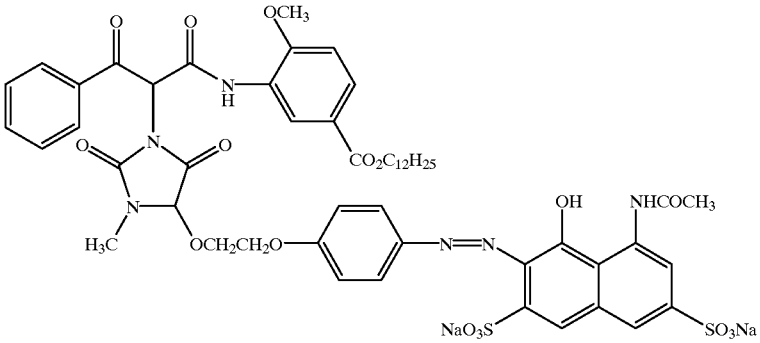
(27)
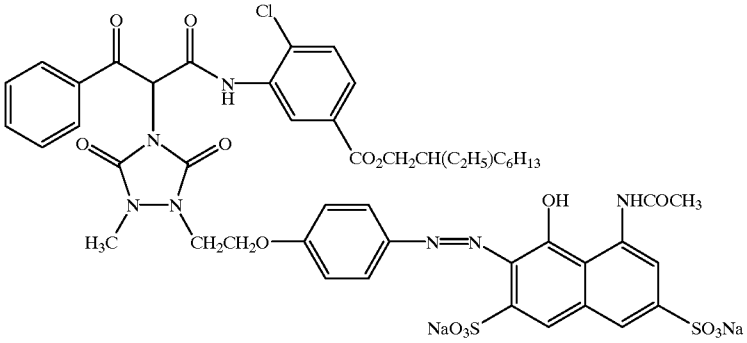
(28)
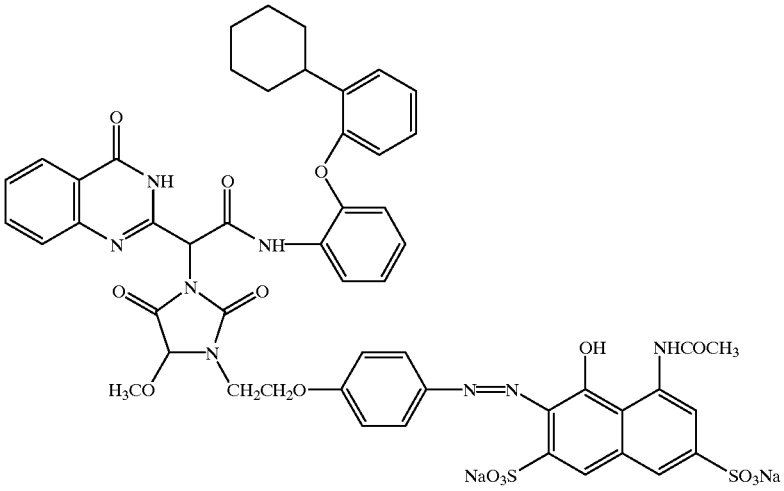

-continued
(29)
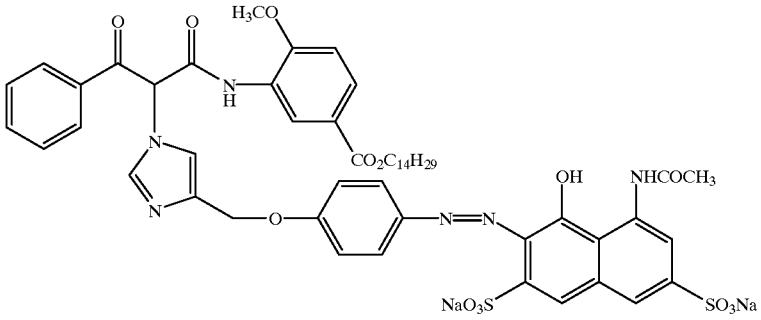
(30)
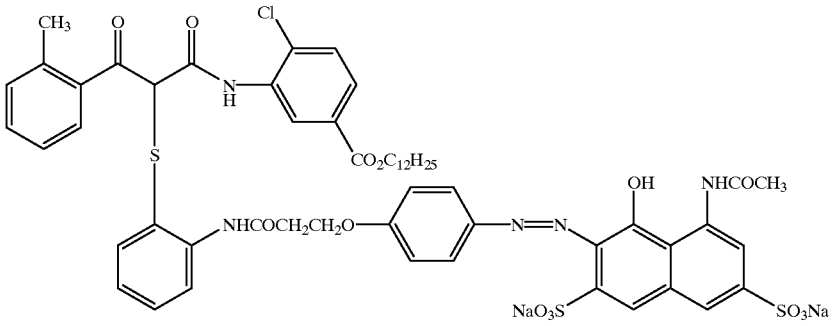
(31)
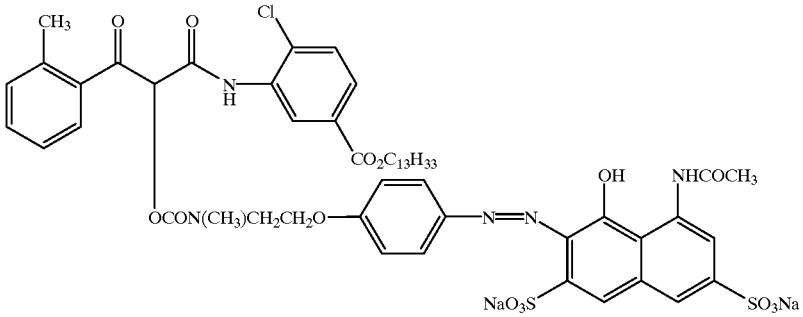
(32)
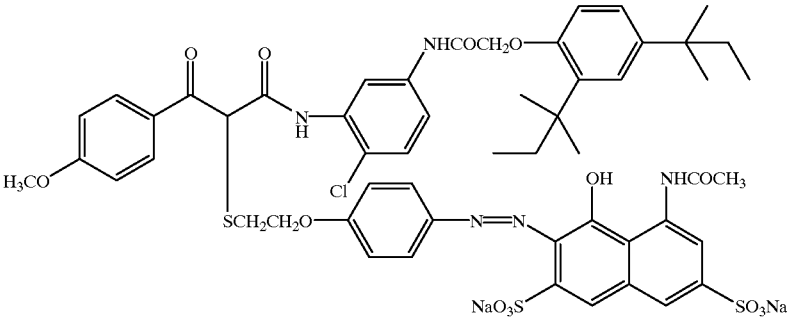

-continued
(33)
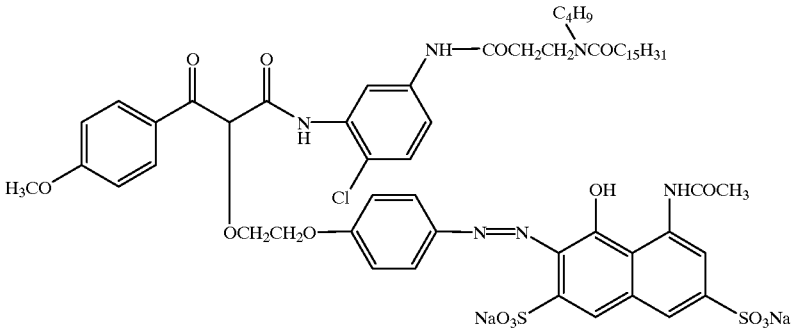
(34)
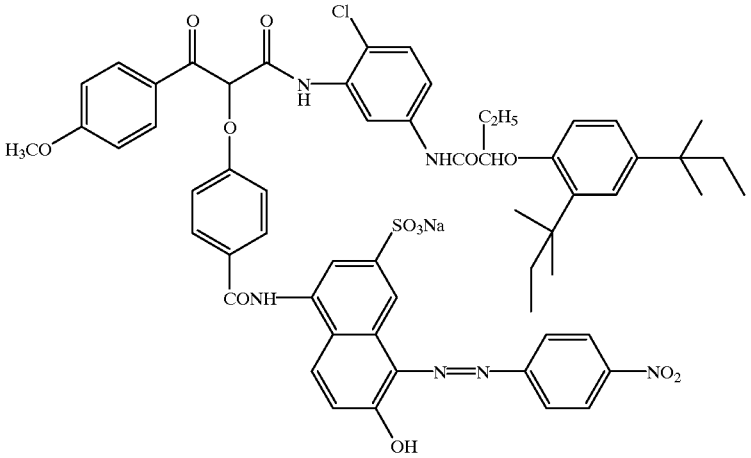
(35)
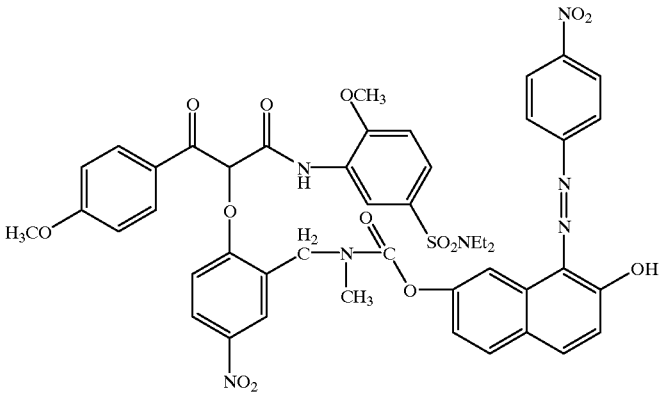

-continued
(36)
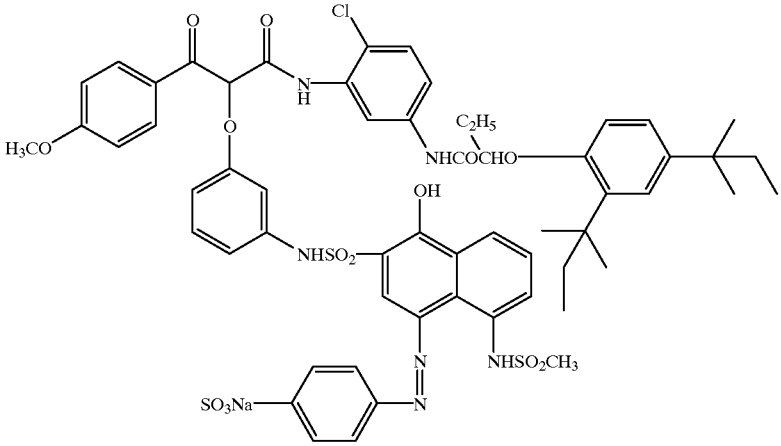
(37)
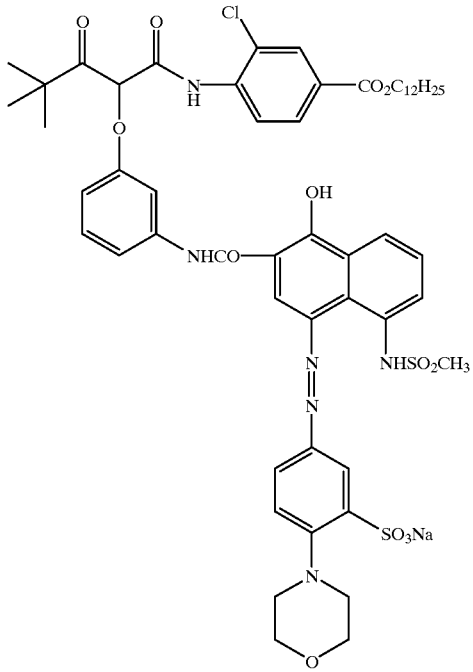
(38)
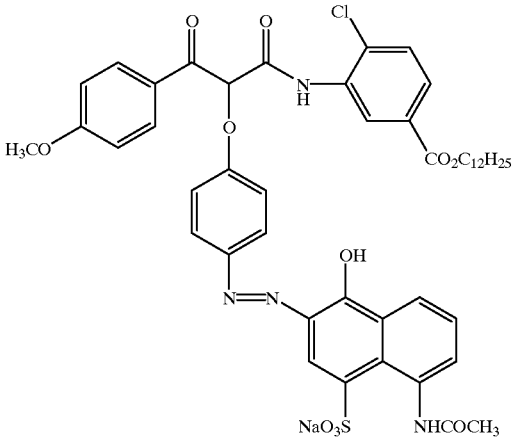

-continued
(39)
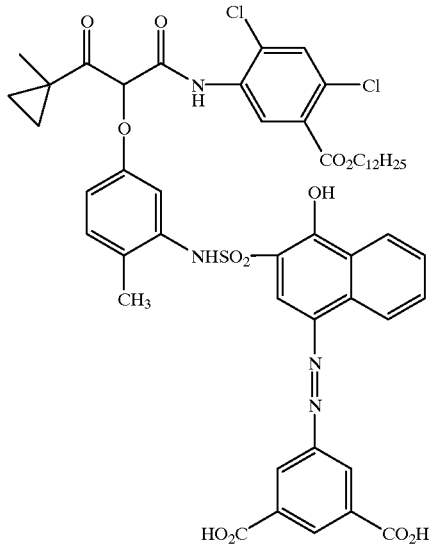
(40)
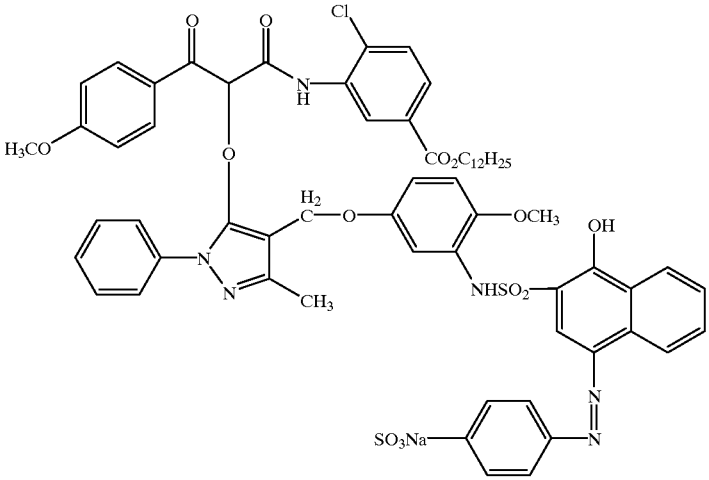
(41)
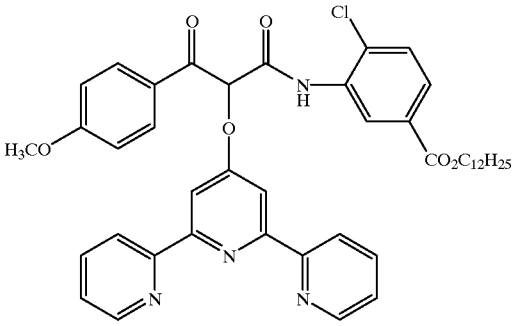

-continued
(42)
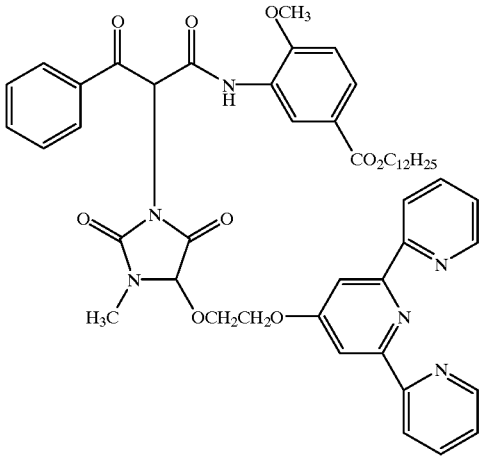
(43)
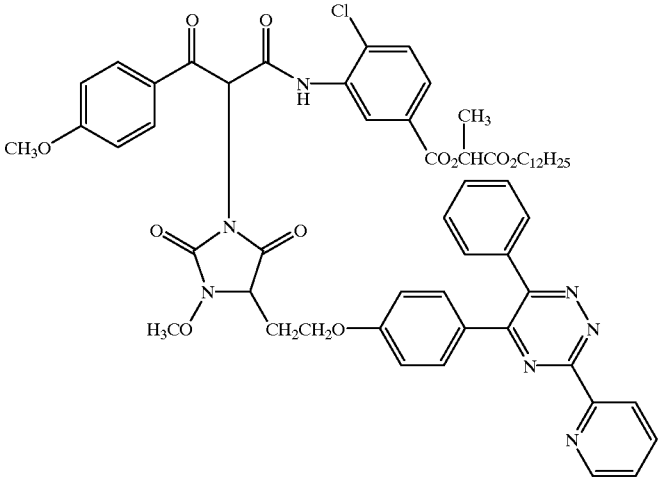
(44)
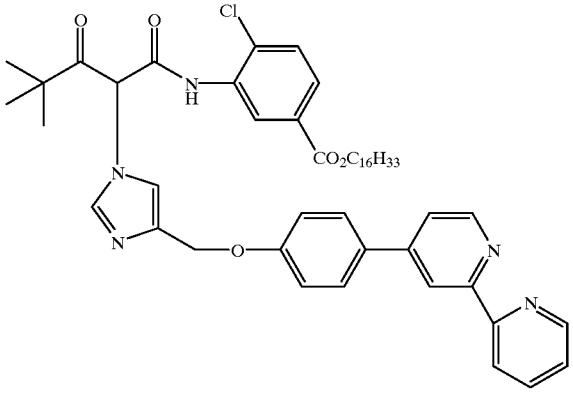

-continued
(45)
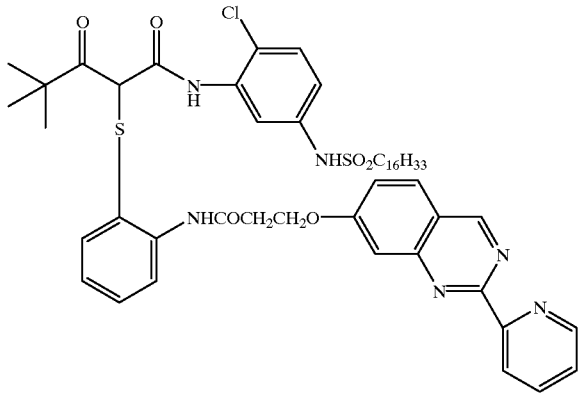
(46)
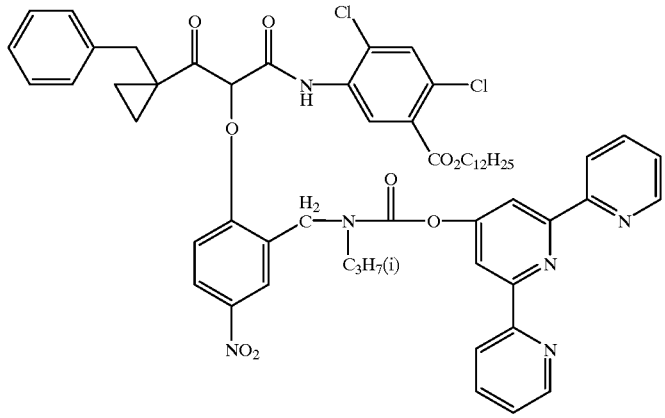
(47)
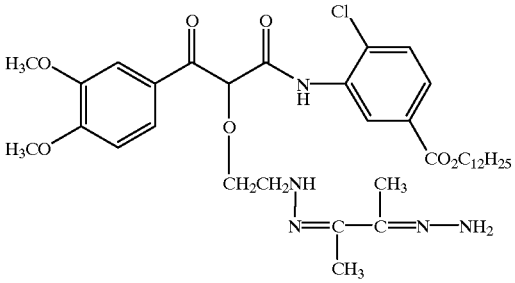
(48)
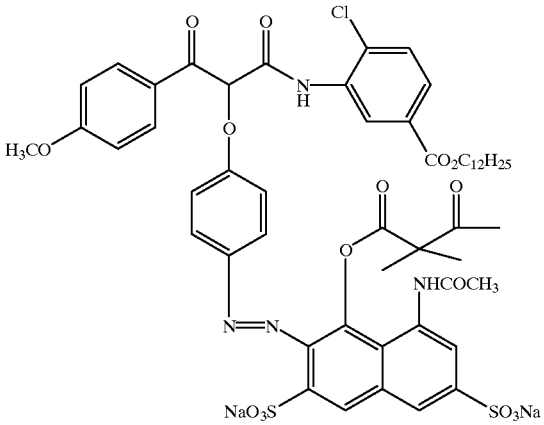

-continued
(49)
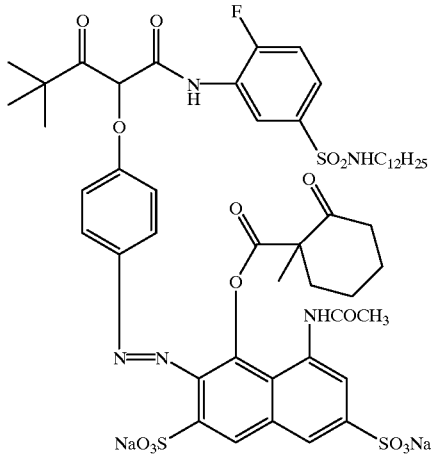
(50)
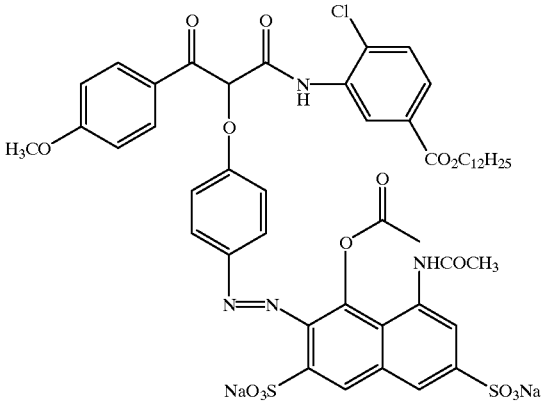
(51)
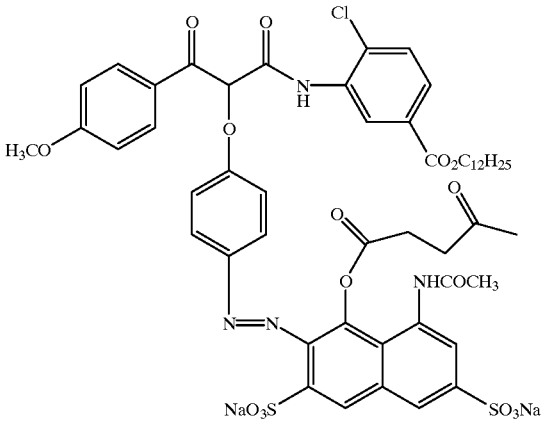

-continued
(52)
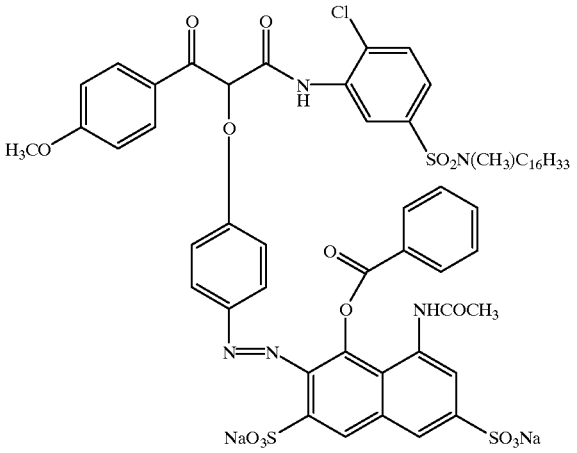
(53)
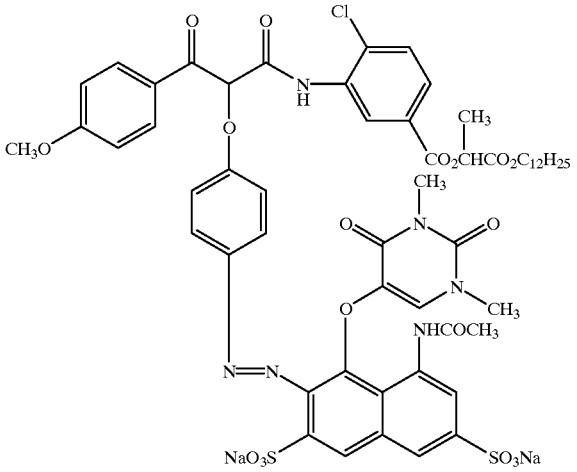
(54)
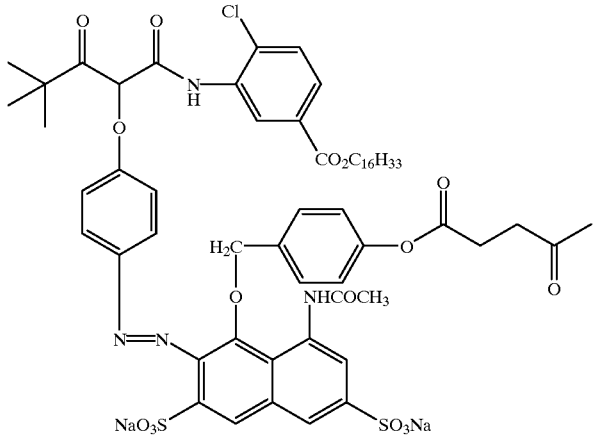

-continued
(55)
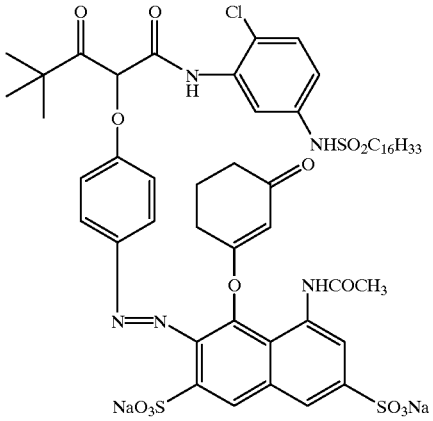
(56)
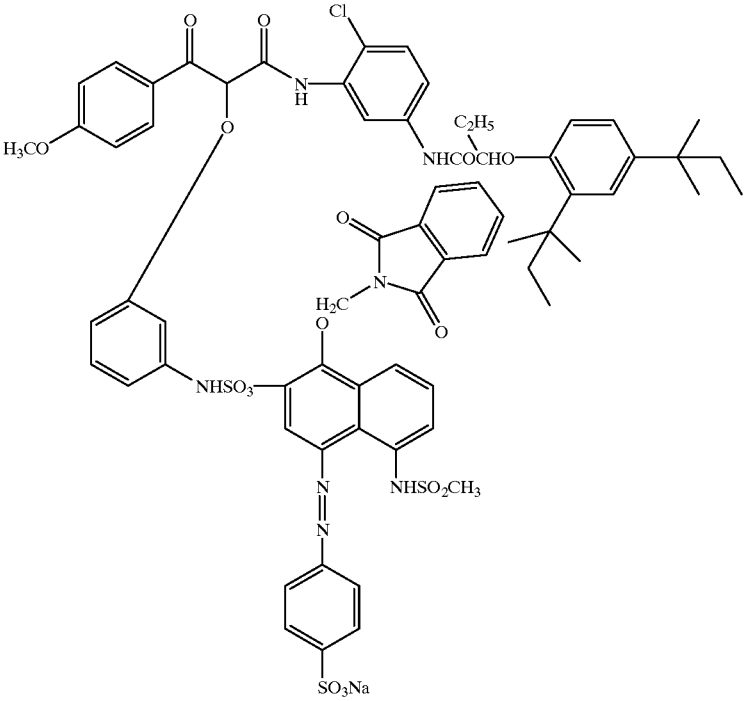

-continued
(57)
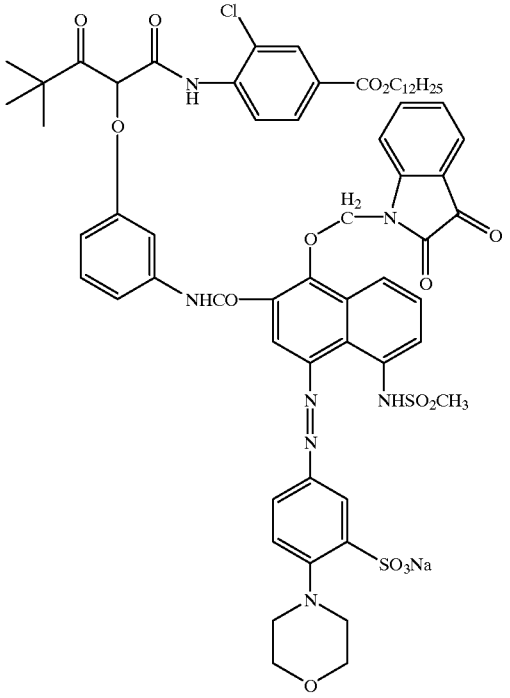
(58)
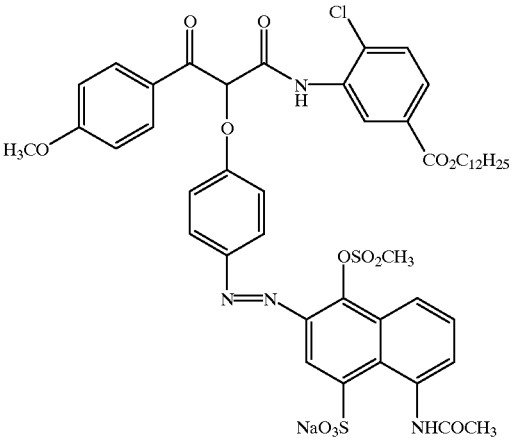

-continued
(59)
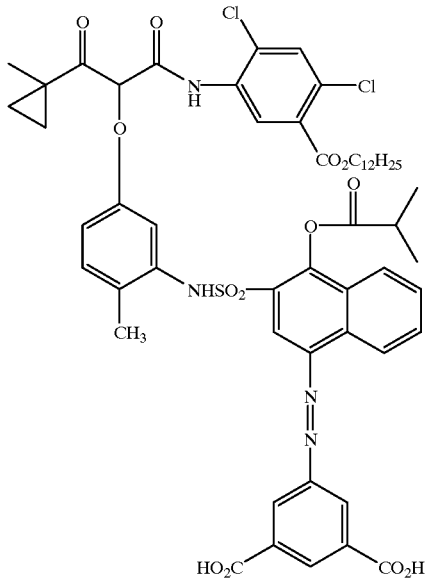
(60)
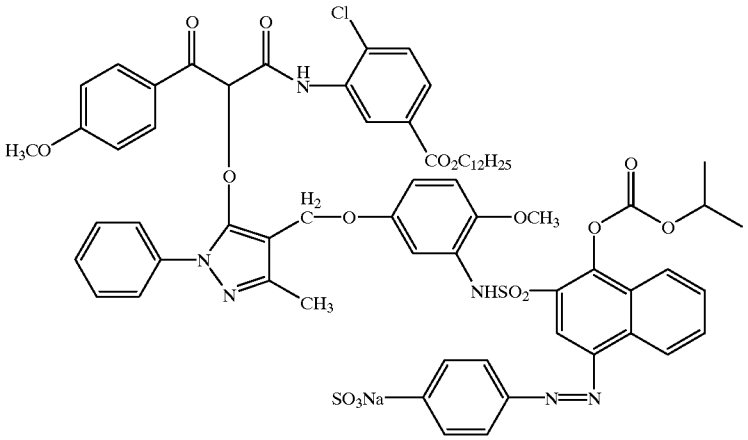
(61)
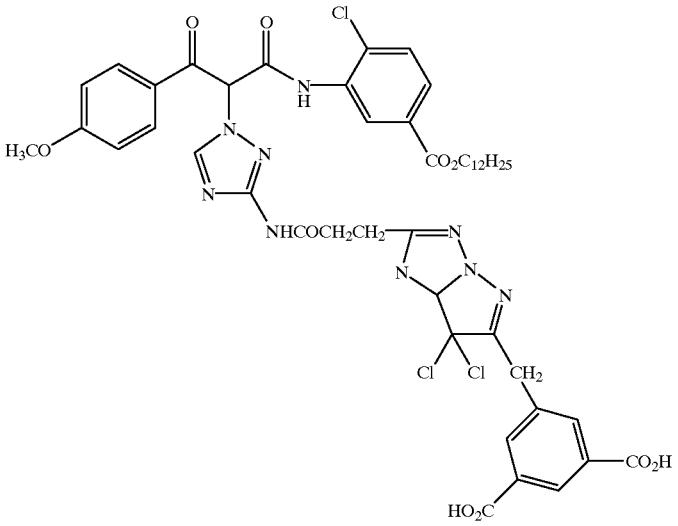

-continued
(62)
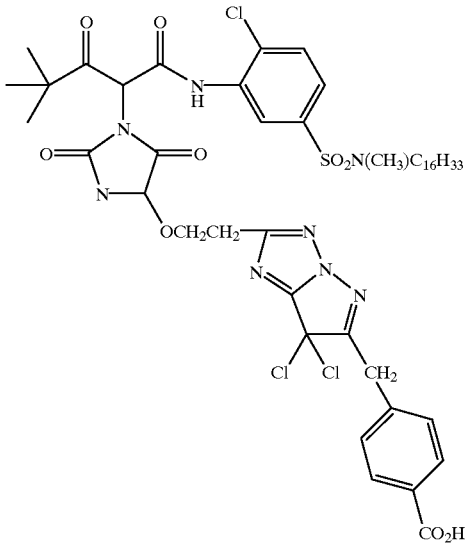
(63)
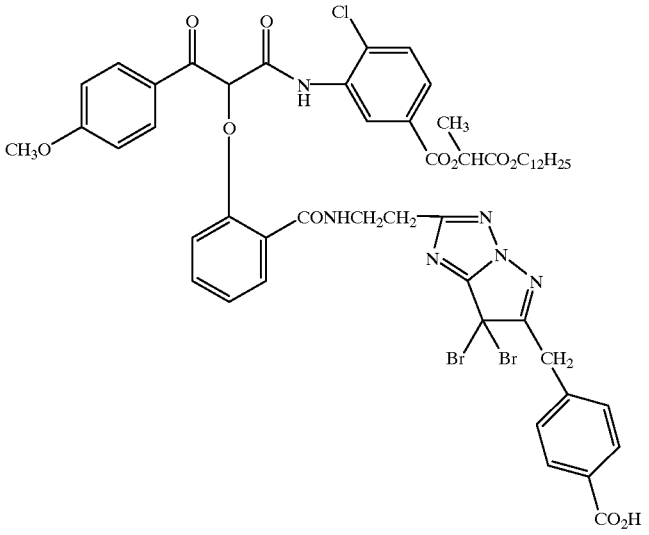
(64)
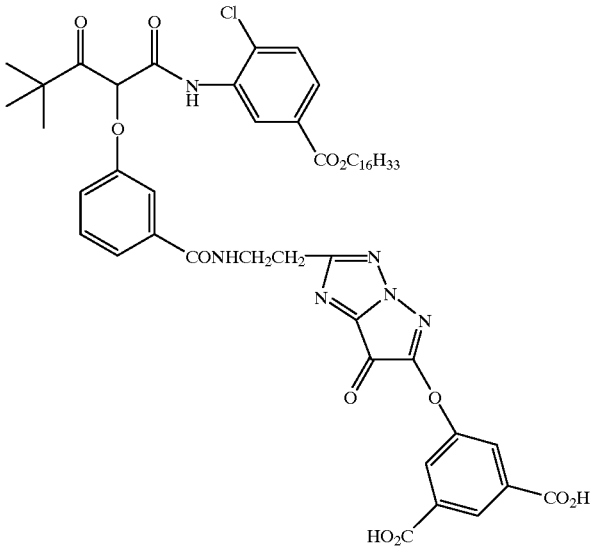

-continued
(65)
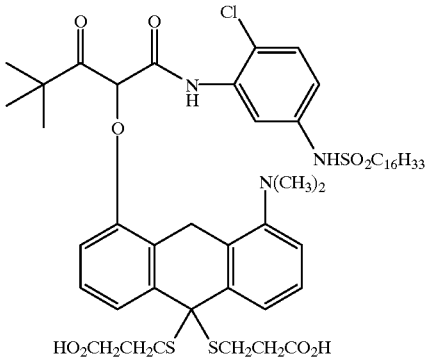
(66)
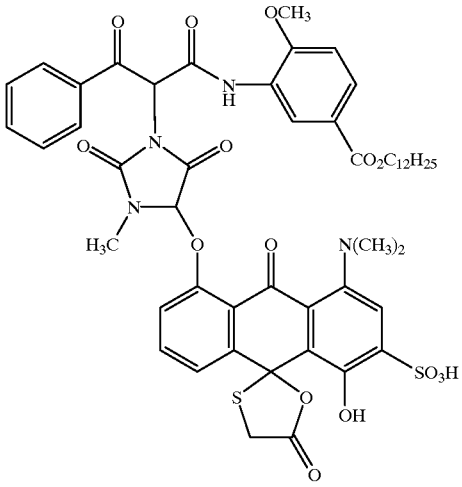
(67)
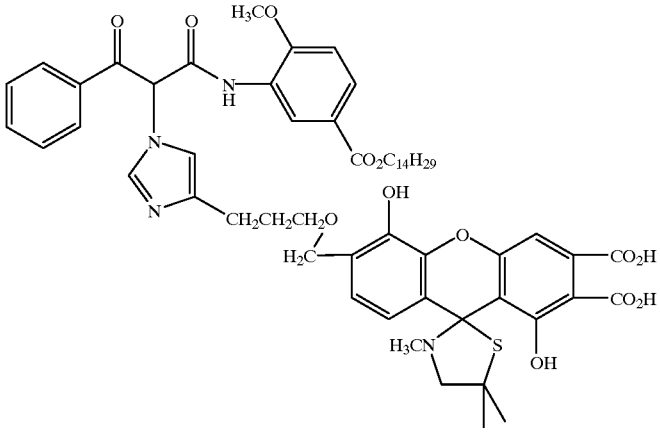

-continued (68)

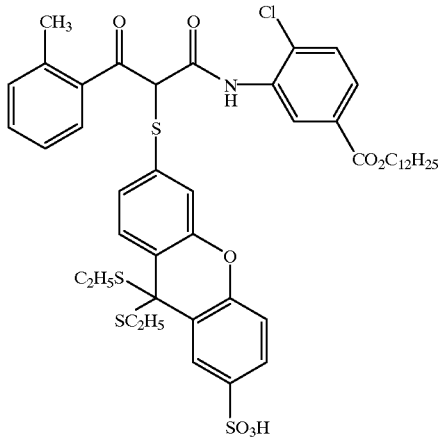

(69)

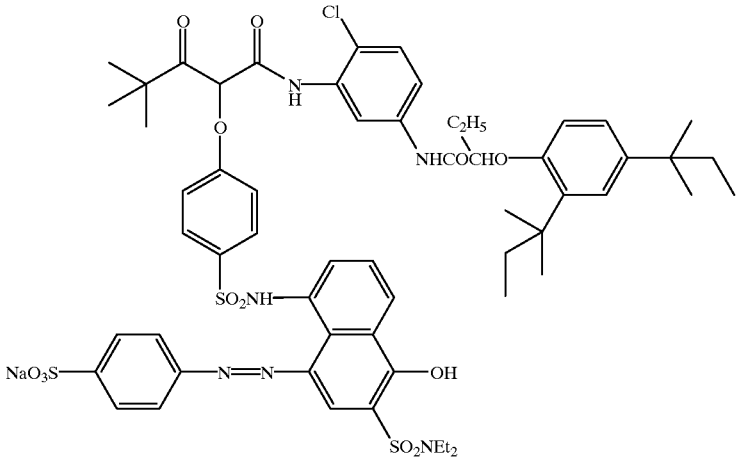

The coating amount of magenta colored yellow coupler of the general formula (I) for use in the present invention is preferably in the range of 0.005 to 0.15 g/m$^2$, more preferably 0.01 to 0.1 g/m$^2$.

The magenta colored yellow couplers of the general formula (I) of the present invention are preferably incorporated in a lightsensitive silver halide emulsion layer, more preferably a blue-sensitive silver halide emulsion layer. When the blue-sensitive silver halide emulsion layer comprises two or more blue-sensitive sub-layers each having different speeds to each other, the coupler of formula (I) of the present invention is preferably added to all the blue-sensitive sub-layers.

Methods of enhancing the image quality of a color photographic lightsensitive material with the use of magenta colored yellow couplers are also described in, for example, U.S. Pat. No. 5,399,468 and JP-A-6-67377. However, all the lightsensitive materials obtained thereby cannot meet the reduction of processing time, therefore, different from the present invention.

With respect to the silver halide composition, the high-silver chloride emulsion for use in the present invention preferably consists of a silver chlorobromide whose silver bromide content is about 50 mol % or less, or consists of a pure silver chloride emulsion. It is more preferred that the emulsion contain substantially no silver bromide, or, if containing, the content thereof is about 10 mol % or less. It is much more preferred that the emulsion consist of silver chloride or a silver chlorobromide whose silver bromide content is 5 mol % or less. Further, if necessary, the emulsion may contain a small amount (10 mol % or less) of silver iodide.

The lightsensitive material of the present invention necessarily comprises a support and, superimposed thereon, at least one red-sensitive silver halide emulsion layer, at least one green-sensitive silver halide emulsion layer and at least one blue-sensitive silver halide emulsion layer. The number and arranged sequence of silver halide emulsion layers and nonlightsensitive layers are not particularly limited. In a multilayer silver halide color photographic lightsensitive material, the unit lightsensitive layers are generally arranged in the sequence of red-, green- and blue-sensitive layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors, which are described later. As a plurality of silver halide emulsion layers constituting each unit lightsensitive layer, a two-layered structure of high- and low-speed emulsion layers is preferably arranged so that the sensitivity is sequentially decreased toward a support as described in DE No. 1,121,470 or GB No. 923,045, the disclosure of which is incorporated herewith by reference. Also, as described in JP-A's-57-112751, 62-200350, 62-206541 and 62-206543, the disclosures of which are incorporated herein by reference, layers can be arranged so that a low-speed emulsion layer is formed on a side remote from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in Jpn. Pat. Appln.

KOKOKU Publication No. (hereinafter referred to as JP-B-) 55-34932, the disclosure of which is incorporated herewith by reference, layers can be arranged, from the farthest side from a support, in the order of blue-sensitive layer/GH/RH/GL/RL. Furthermore, as described in JP-A-56-25738 and JP-A-62-63936, the disclosures of which are incorporated herein by reference, layers can be arranged, from the farthest side from a support, in the order of blue-sensitive layer/GL/RL/GH/RH.

As described in JP-B-49-15495, the disclosure of which is incorporated herewith by reference, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herewith by reference.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

In order to improve the color reproducibility, a donor layer (CL) of an interlayer effect having a spectral sensitivity distribution different from the main lightsensitive layers of BL, GL and RL as described in U.S. Pat. Nos. 4,663,271, 4,705,744, and 4,707,436, and JP-A's-62-160448 and 63-89850 is preferably arranged adjacent to or close to the main lightsensitive layers.

Silver halide grains contained in the photographic emulsion may those having regular crystals such as cubic, octahedral or tetradecahedral crystals, having irregular crystals such as spherical or tabular crystals or having crystal defects such as twinned crystal faces, or composite forms thereof.

With respect to the grain diameter, the silver halide can consist of fine grains having a grain size of about 0.2 $\mu$m or less or large grains having a projected area diameter of up to about 10 $\mu$m, and the emulsion may be either a polydisperse or monodisperse emulsion.

The silver halide photographic emulsion which can be used in the present invention can be prepared by methods described in, e.g., "I. Emulsion preparation and types," Research Disclosure (to be abbreviated as RD hereafter) No. 17643 (December, 1978), pp. 22 and 23; RD No. 18716 (November, 1979), page 648; RD No. 307105 (November, 1989), pp. 863 to 865; P. Glafkides, "Chemie et Phisique Photographiques", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628, and 3,655,394 and GB No. 1,413,748 are also preferable.

Also, tabular grains having an aspect ratio of about 3 or more can be used in the present invention.

Tabular grains can be easily prepared by methods described in, e.g., Gutoff, "Photographic Science and Engineering", Vol. 14, pp. 248 to 257 (1970), U.S. Pat. Nos. 4,434,226, 4,414,310, 4,433,048, and 4,439,520, and GB No. 2,112,157.

The crystal structure can be uniform, can have halogen compositions which are different between the inner part and the outer part thereof, or can be a layered structure. Alternatively, the silver halide can be bonded with a silver halide having a different composition by an epitaxial junction, for example, can be bonded with a compound other than silver halide such as silver rhodanide or lead oxide. A mixture of grains having various crystal forms can also be used.

The above emulsion may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740, whose productive process is described in JP-A-59-133542. The thickness of the shell of this emulsion, although varied depending on development processing, etc., is preferably in the range of 3 to 40 nm, more preferably 5 to 20 nm.

The silver halide emulsion is generally subjected to physical ripening, chemical sensitization and spectral sensitization before use. Additives employed in these steps are described in RD Nos. 17643, 18716 and 307105. Positions where the description is made are listed in the following table.

With respect to the lightsensitive material of the present invention, at least two emulsions which are different from each other in at least one of the characteristics, specifically the grain size, grain size distribution, halogen composition, grain configuration and sensitivity of lightsensitive silver halide emulsion, can be mixed together and used in one layer.

It is preferred that silver halide grains having a grain surface fogged as described in U.S. Pat. No. 4,082,553, silver halide grains having a grain internal portion fogged as described in U.S. Pat. No. 4,626,498 and JP-A-59-214852 and colloidal silver be used in lightsensitive silver halide emulsion layers and/or substantially nonlightsensitive hydrophilic colloid layers. The expression "silver halide grains having a grain surface or grain internal portion fogged" refers to silver halide grains which can be developed uniformly (nonimagewise) irrespective of the nonexposed or exposed zone of lightsensitive material. The process for producing them is described in U.S. Pat. No. 4,626,498 and JP-A-59-214852. The silver halides constituting internal nuclei of core/shell silver halide grains having a grain internal portion fogged may have different halogen composition. Any of silver chloride, silver chlorobromide, silver iodobromide and silver chloroiodobromide can be used as the silver halide having a grain surface or grain internal portion fogged. The average grain size of these fogged silver halide grains is preferably in the range of 0.01 to 0.75 μm, more preferably 0.05 to 0.6 μm. With respect to grain configuration, although both regular grains and a polydisperse emulsion can be used, monodispersity (at least 95% of the weight or number of silver halide grains have grain sizes falling within ±40% of the average grain size) is preferred.

In the present invention, it is preferred to use nonlightsensitive fine grain silver halide. The expression "nonlightsensitive fine grain silver halide" refers to silver halide fine grains which are not sensitive at the time of imagewise exposure for obtaining dye image and which are substantially not developed at the time of development processing thereof. Those not fogged in advance are preferred. The fine grain silver halide has a silver bromide content of 0 to 100 mol %, and, if necessary, may contain silver chloride and/or silver iodide. Preferably, silver iodide is contained in an amount of 0.5 to 10 mol %. The average grain size (average of equivalent circular diameter of projected area) of fine grain silver halide is preferably in the range of 0.01 to 0.5 μm, more preferably 0.02 to 0.2 μm.

The fine grain silver halide can be prepared by the same process as used in the preparation of common lightsensitive silver halide.

It is not needed to optically sensitize the grain surface of fine grain silver halide. Further, a spectral sensitization thereof is also not needed.

However, it is preferred to add known stabilizers such as triazoles, azaindenes, benzothiazoliums and mercapto compounds and zinc compounds thereto prior to the addition thereof to a coating liquid. Colloidal silver can be contained in the fine grain silver halide containing layers.

The silver coating amount of the lightsensitive material of the present invention is preferably 6.0 g/m$^2$ or less, most preferably 4.5 g/m$^2$ or less.

Photographic additives usable in the present invention are also described in RDs, and the relevant description portions are summarized in the following table.

| | Types of Additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | | pages 878–879 |

Various dye forming couplers can be used in the lightsensitive material of the present invention, and the following couplers are particularly preferable.

Yellow couplers: couplers represented by formulas (I) and (II) in EP No. 502,424A; couplers represented by formulas (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulas (II) to (IV) in column 7, lines 36 to 58, in U.S. Pat. No. B4,476,219 (particularly II-17, II-19 (column 17), and II-24 (column 19)), the disclosures of the above documents disclosing the yellow couplers are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and -75 (page 139) in EP No. 456,257; M-4 and -6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, the disclosures of the above documents disclosing the magenta couplers are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulas (Ia) and (Ib) in claim 1 of JP-A-6-67385, the disclosures of the above documents disclosing the cyan couplers are incorporated herein by reference.

Polymer couplers: P-1 and P-5 (page 11) in JP-A-2-44345, the disclosure of which is incorporated herein by reference.

Couplers for forming a colored dye with a proper diffusibility are preferably those described in U.S. Pat. No. 4,366,237, GB No. 2,125,570, EP No. 96,873B, and DE No. 3,234,533, the disclosures of which are incorporated herein by reference.

As couplers for correcting the unnecessary absorption of a colored dye, preferred use is made of, besides the magenta colored yellow couplers of the present invention, yellow colored cyan couplers represented by formulas (CI), (CII), (CIII), and (CIV) described on page 5 in EP No. 456,257A1 (particularly YC-86 on page 84); yellow colored magenta couplers ExM-7 (page 202), Ex-1 (page 249), and EX-7 (page 251) described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), the disclosures of all the documents disclosing the couplers for correcting the unnecessary absorption of a colored dye are incorporated herein by reference.

Examples of compounds (including a coupler) which react with a developing agent in an oxidized form to thereby release a photographically useful compound residue are as follows. Development inhibitor release compounds: compounds represented by formulas (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D-49 (page 51)); a compound represented by formula (1) in EP No. 568,037A (particularly (23) (page 11)); and compounds represented by formulas (I), (II), and (III) on pages 5 and 6 of EP No. 440,195A2 (particularly I-(1) on page 29). Bleaching accelerator release compounds: compounds represented by formulas (I) and (I') on page 5 of EP No. 310,125A2 (particularly (60) and (61) on page 61); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulas (1), (2), and (3) in column 3 of U.S. Pat. No. 4,656,123 (particularly (I-22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199,363. Scavengers of developing agent in an oxidized form: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color amalgamation inhibitor: I-1 to II-15, particularly I-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulas (VII) to (XII) in columns 13 to 23 of U.S. Pat. No. 4,618,573;, compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-1 to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulas (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520,938A; and compounds (1) to (31) (columns 2 to 9) represented by formula (1) in EP No. 521,823A.

The present invention can be applied to various color lightsensitive materials such as color negative films for general purposes or cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the lightsensitive material of the present invention, the total of film thicknesses of all hydrophilic colloid layers on the side having emulsion layers is preferably 28 $\mu$m or less, more preferably 23 $\mu$m or less, still more preferably 18 $\mu$m or less, and most preferably 16 $\mu$m or less. Film swelling speed $T_{1/2}$ is preferably 30 sec or less, more preferably 20 sec or less. The film swelling speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

[maximum swollen film thickness−film thickness]/film thickness.

In the lightsensitive material of the present invention, hydrophilic colloid layers (called "back layers") having a total dried film thickness of 2 to 20 $\mu$m are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The lightsensitive material of the present invention can be developed by conventional methods described in RD. No. 17643, pages 28 and 29; RD. No. 18716, page 651, left to right columns; and RD No. 307105, pages 880 and 881, but the lightsensitive material of the present invention it characterized in that is can be processed rapidly.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol. more preferably 0.015 to 0.06 mol, and much more preferably 0.02 to 0.05 mol per liter (L) of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents for example, alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl)hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, more preferably from 10.0 to 10.5. That of the replenisher is preferably set at 0.1 to 1.0 higher than the above value. Common buffers such as carbonate, phosphonate, sulfosalicylate and borate are used for stabilizing the above pH value.

Although the amount of the replenisher of the color developing solution preferably ranges from 80 to 1300 mL per $m^2$ of the lightsensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

wherein

C: bromide ion concentration of the color developing replenisher (mol/L),

A: target bromide ion concentration of the color developing solution (mol/L),

W: amount of bromide ion leached from the lightsensitive material into the color developing solution when a color development of 1 $m^2$ of the lightsensitive material has been carried out (mol), and V: amount of color developing replenisher supplied per $m^2$ of the lightsensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A's-4-251845, and 4-268552, EP Nos. 588,289, and 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$C_R=C_T\times(V_1+V_2)/V_1+C_p$$

$C_R$: concentration of each component in the replenisher, $C_T$: concentration of the component in the mother liquor (processing tank solution), $C_P$: component concentration consumed during processing, $V_1$: amount of replenisher having bleaching capability supplied per $m^2$ of lightsensitive material (mL), and $V_2$: amount carried from previous bath by 1 $m^2$ of lightsensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and much more preferably 100 to 300 mL, of a bleaching replenisher per $m^2$ of the lightsensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the bleach ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and especially preferably 200 to 600 mL, per $m^2$ of the lightsensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP Nos. 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the lightsensitive material.

The replenishing amount of water washing and stabilizing solutions is preferably in the range of 80 to 1000 mL, more preferably 100 to 500 mL, and much more preferably 150 to 300 mL, per $m^2$ of the lightsensitive material from the viewpoint that water washing and stabilizing functions are ensured and that the amount of waste solution is reduced to contribute to environment protection. In the processing with the above replenishing amount, any of known mildewproofing agents such as thiabenzazole, 1,2-benzoisothiazolin-3-one and 5-chloro-2-methylisothiazolin-3-one and antibiotics such as gentamicin is preferably added, or water deionized by the use of, for example, an ion exchange resin is preferably used, for preventing the breeding of bacteria and mildew. The use of deionized water in combination with a mildewproofing agent and an antibiotic is more effective than individual uses.

With respect to the solution placed in the water washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used in the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably harvested from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out the present invention are described on page 5, right column, line 11 to page 7, right column, last line of the above journal of technical disclosure.

The processing agent for use in the present invention may be supplied in any form, for example, a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A-51-61837 and JP-A-6-102628 and a paste processing agent in PCT National Publication 57-500485. Although any of these can be suitably used, from the viewpoint of easiness in use, it is preferred to employ a liquid prepared in the same concentration as in use in advance.

The container for storing the above processing agent is composed of, for example, any one or a mixture of polyethylene, polypropylene, polyvinyl chloride, polyethylene terephthalate and nylon. A selection is made in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 $\mu$m so that the oxygen permeability therethrough is 20 mL/m$^2$·24 hrs·atm or less.

The processing solution for color reversal film to be employed in the present invention will be described below.

With respect to the processing for color reversal film, detailed descriptions are made in Public Technology No. 6 (Apr. 1, 1991) issued by Aztek, page 1, line 5 to page 10, line 5 and page 15, line 8 to page 24, line 2, any of which can be preferably applied thereto.

In the color reversal film processing, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment, Among the N-methylolazoles, N-methyloltriazole is especially preferred. The contents of descriptions on color developing solution, bleaching solution, fixing solution and washing water made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

The color photographic lightsensitive material of the present invention is suitably used as a color negative film for Advanced Photo System (hereinafter referred to as "APS"). It is, for example, one obtained by working the film into APS format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for APS is charged in a camera for APS such as Epion series, e.g., Epion 300Z, produced by Fuji Film and put to practical use. Moreover, the color photographic lightsensitive material of the present invention is suitable to a lens equipped film, such as Fuji Color Uturundesu Super Slim produced by Fuji Film.

The thus photographed film is printed through the following steps in a minilabo system:

(1) acceptance (receiving an exposed cartridge film from a customer), (2) detaching (transferring the film from the above cartridge to an intermediate cartridge for development), (3) film development, (4) reattaching (returning the developed negative film to the original cartridge), (5) printing (continuous automatic printing of C, H and P three-type print and index print on color paper (preferably, Super FA8 produced by Fuji Film)), and (6) collation and delivery (collating the cartridge and index print with ID number and delivering the same with prints).

The above system is preferably Fuji Film Minilabo Champion Super FA-298/FA-278/FA-258/FA-238. Film processor is, for example, FP922AL/FP562B/FP562BL/FP362B/FP3622BL, and recommended processing chemical is Fuji Color Just It CN-16L. Printer processor is, for example, PP3008AR/PP3008A/PP1828AR/PP1828A/PP1258AR/PP1258A/PP72 8AR/PP728A, and recommended processing chemical thereof is Fuji Color Just It CP-47L. Fuji Film DT200/DT100 and AT200/AT100 are preferably used as detacher in the detaching step and as rear toucher in the rear touching step, respectively.

The APS system can be enjoyed by photo joy system whose center unit is Fuji Film digital image work station Aladdin 1000. For example, developed APS cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed APS cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in the personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed APS cartridge film.

EXAMPLES

The present invention will be described in more detail below by way of its examples. However, the present invention is not limited to these examples as long as the invention does not depart from the gist of the invention.

Example 1

A support of cellulose triacetate film furnished with a substratum was coated with a plurality of layers of the following compositions, thereby preparing multilayer color lightsensitive material sample 101.

(Composition of lightsensitive layer)

Main materials for use in each layer are classified as follows:

| | |
|---|---|
| ExC: cyan coupler | UV: ultraviolet absorber |
| ExM: magenta coupler | HBS: high b.p. organic solvent |
| ExY: yellow coupler | H: gelatin hardener |
| ExS: sensitizing dye. | |

The figure given beside the description of each component is for the coating amount expressed in the unit of g/m$^2$. With respect to a silver halide, the coating amount is in terms of silver, provided that, regarding the sensitizing dye, the coating amount is expressed in the unit of mol per mol of silver halide present in the same layer (Sample 101).

| | |
|---|---|
| **1st layer (1st antihalation layer)** | |
| Silver chlorobromide emulsion P silver | 0.01 |
| Gelatin | 0.87 |
| ExC-1 | 0.002 |
| ExC-3 | 0.002 |
| Cpd-2 | 0.001 |
| HBS-1 | 0.004 |
| HBS-2 | 0.002 |
| **2nd layer (2nd antihalation layer)** | |
| Gelatin | 0.407 |
| ExM-1 | 0.050 |
| ExF-1 | $2.0 \times 10^{-3}$ |
| HBS-1 | 0.074 |
| Solid disperse dye ExF-2 | 0.030 |
| **3rd layer (Interlayer)** | |
| ExC-2 | 0.022 |
| Polyethyl acrylate latex | 0.085 |
| Gelatin | 0.294 |
| **4th layer (Low-speed red-sensitive emulsion layer)** | |
| Silver chloroiodobromide emulsion A silver | 0.323 |
| ExS-1 | $3.8 \times 10^{-4}$ |
| ExS-2 | $1.0 \times 10^{-5}$ |
| ExS-3 | $2.4 \times 10^{-4}$ |
| ExS-4 | $1.0 \times 10^{-4}$ |
| ExS-12 | $2.7 \times 10^{-4}$ |
| ExC-1 | 0.109 |
| ExC-3 | 0.044 |
| ExC-4 | 0.072 |
| ExC-5 | 0.011 |
| ExC-6 | 0.003 |
| Cpd-2 | 0.025 |
| Cpd-4 | 0.025 |
| HBS-1 | 0.17 |
| Gelatin | 0.80 |
| **5th layer (Medium-speed red-sensitive emulsion layer)** | |
| Silver chloroiodobromide emulsion B silver | 0.28 |
| Silver chloroiodobromide emulsion C silver | 0.54 |
| ExS-1 | $4.8 \times 10^{-4}$ |
| ExS-2 | $1.8 \times 10^{-5}$ |
| ExS-3 | $2.8 \times 10^{-4}$ |
| ExS-4 | $0.7 \times 10^{-4}$ |
| ExS-12 | $1.8 \times 10^{-4}$ |
| ExC-2 | 0.026 |
| ExC-3 | 0.020 |
| ExC-4 | 0.12 |
| ExC-5 | 0.016 |
| ExC-6 | 0.007 |
| Cpd-2 | 0.036 |
| Cpd-4 | 0.028 |

-continued

| | |
|---|---|
| HBS-1 | 0.16 |
| Gelatin | 1.18 |
| **6th layer (High-speed red-sensitive emulsion layer)** | |
| Silver chloroiodobromide emulsion D silver | 1.47 |
| ExS-1 | $3.4 \times 10^{-4}$ |
| ExS-2 | $1.4 \times 10^{-5}$ |
| ExS-3 | $2.2 \times 10^{-4}$ |
| ExS-4 | $0.5 \times 10^{-4}$ |
| ExS-12 | $1.8 \times 10^{-4}$ |
| ExC-3 | 0.07 |
| ExC-6 | 0.029 |
| ExC-7 | 0.010 |
| ExY-5 | 0.008 |
| Cpd-2 | 0.046 |
| Cpd-4 | 0.077 |
| HBS-1 | 0.25 |
| HBS-2 | 0.12 |
| Gelatin | 2.12 |
| **7th layer (Interlayer)** | |
| Cpd-1 | 0.089 |
| Solid disperse dye ExF-4 | 0.030 |
| HBS-1 | 0.050 |
| Polyethyl acrylate latex | 0.83 |
| Gelatin | 0.84 |
| **8th layer (Layer capable of imparting interlayer effect to red-sensitive layer)** | |
| Silver chloroiodobromide emulsion E silver | 0.560 |
| ExS-6 | $2.8 \times 10^{-4}$ |
| ExS-10 | $5.9 \times 10^{-4}$ |
| Cpd-4 | 0.030 |
| ExM-2 | 0.096 |
| ExM-3 | 0.028 |
| ExY-1 | 0.031 |
| HBS-1 | 0.085 |
| HBS-3 | 0.003 |
| Gelatin | 0.58 |
| **9th layer (Low-speed green-sensitive emulsion layer)** | |
| Silver chloroiodobromide emulsion F silver | 0.39 |
| Silver chloroiodobromide emulsion G silver | 0.28 |
| Silver chloroiodobromide emulsion H silver | 0.35 |
| ExS-4 | $1.4 \times 10^{-5}$ |
| ExS-5 | $1.0 \times 10^{-4}$ |
| ExS-6 | $1.9 \times 10^{-4}$ |
| ExS-7 | $3.7 \times 10^{-5}$ |
| ExS-8 | $1.0 \times 10^{-4}$ |
| ExS-12 | $1.0 \times 10^{-4}$ |
| ExS-13 | $6.2 \times 10^{-4}$ |
| ExM-2 | 0.36 |
| ExM-3 | 0.045 |
| HBS-1 | 0.28 |
| HBS-3 | 0.01 |
| HBS-4 | 0.27 |
| Gelatin | 1.39 |
| **10th layer (Medium-speed green-sensitive emulsion layer)** | |
| Silver chloroiodobromide emulsion I silver | 0.45 |
| ExS-4 | $2.3 \times 10^{-5}$ |
| ExS-7 | $1.0 \times 10^{-4}$ |
| ExS-8 | $2.3 \times 10^{-4}$ |
| ExS-12 | $1.0 \times 10^{-4}$ |
| ExS-13 | $8.2 \times 10^{-4}$ |
| ExM-2 | 0.031 |
| ExM-3 | 0.029 |
| ExY-1 | 0.006 |
| ExM-4 | 0.028 |
| HBS-1 | 0.064 |
| HBS-3 | $2.1 \times 10^{-3}$ |
| Gelatin | 0.44 |
| **11th layer (High-speed green-sensitive emulsion layer)** | |
| Silver chloroiodobromide emulsion I silver | 0.19 |
| Silver chloroiodobromide emulsion J silver | 0.80 |

-continued

| | |
|---|---|
| ExS-4 | $2.1 \times 10^{-5}$ |
| ExS-7 | $1.0 \times 10^{-4}$ |
| ExS-8 | $1.9 \times 10^{-4}$ |
| ExS-12 | $1.0 \times 10^{-4}$ |
| ExS-13 | $5.2 \times 10^{-4}$ |
| ExC-6 | 0.004 |
| ExM-1 | 0.016 |
| ExM-3 | 0.036 |
| ExM-4 | 0.020 |
| ExM-5 | 0.004 |
| ExY-5 | 0.003 |
| ExM-2 | 0.013 |
| Cpd-3 | 0.004 |
| Cpd-4 | 0.007 |
| HBS-1 | 0.18 |
| Polyethyl acrylate latex | 0.099 |
| Gelatin | 1.11 |
| 12th layer (Interlayer) | |
| Cpd-1 | 0.16 |
| HBS-1 | 0.082 |
| Gelatin | 1.057 |
| 13th layer (Low-speed blue-sensitive emulsion layer) | |
| Silver chloroiodobromide emulsion K silver | 0.28 |
| Silver chloroiodobromide emulsion L silver | 0.30 |
| Silver chloroiodobromide emulsion M silver | 0.10 |
| ExS-9 | $1.0 \times 10^{-4}$ |
| ExS-11 | $1.2 \times 10^{-4}$ |
| ExS-14 | $4.2 \times 10^{-4}$ |
| ExC-8 | 0.012 |
| ExY-2 | 0.71 |
| ExY-3 | 0.10 |
| Cpd-2 | 0.10 |
| Cpd-3 | $4.0 \times 10^{-3}$ |
| HBS-1 | 0.24 |

-continued

| | |
|---|---|
| Gelatin | 1.41 |
| 14th layer (High-speed blue-sensitive emulsion layer) | |
| Silver chloroiodobromide emulsion N silver | 1.05 |
| ExS-9 | $1.6 \times 10^{-4}$ |
| ExS-14 | $4.5 \times 10^{-4}$ |
| ExY-2 | 0.31 |
| ExY-3 | 0.05 |
| Cpd-2 | 0.075 |

-continued

| | |
|---|---|
| Cpd-3 | $1.0 \times 10^{-3}$ |
| HBS-1 | 0.10 |
| Gelatin | 0.91 |
| 15th layer (1st protective layer) | |
| UV-1 | 0.21 |
| UV-2 | 0.13 |
| UV-3 | 0.20 |
| UV-4 | 0.025 |
| F-18 | 0.009 |
| HBS-1 | 0.12 |
| HBS-4 | $5.0 \times 10^{-2}$ |
| Gelatin | 2.3 |
| 16th layer (2nd protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition, W-1 to W-5, B-4 to B-6, F-1 to F-19, iron salt, lead salt, gold salt, platinum salt, palladium salt, iridium salt, ruthenium salt, rhodium salt, calcium salt and the like were appropriately added to the individual layers in order to improve the storage stability, processability, resistance to pressure, antiseptic and mildewproofing properties, antistatic properties, and coating properties.

The Br content, I content, grain size, etc. of each of the above emulsions with codes assigned thereto are specified in the following Table 1.

TABLE 1

| Type of Emulsion | | Variation coefficient on intergranular Br distribution | Br content (mol %) | I content (mol %) | Average grain diameter (equivalent sphere diameter: μm) | Variation coefficient of equivalent sphere diameter (%) | Projected area diameter (equivalent circle diameter: μm) | Ratio of projected area diameter/thickness | Configuration of grain |
|---|---|---|---|---|---|---|---|---|---|
| Emulsion | A | 20 | 3.0 | 0.02 | 0.40 | 19 | 0.55 | 4.0 | Tabular grain |
| | B | 17 | 2.0 | 0.01 | 0.54 | 21 | 0.86 | 6.0 | Tabular grain |
| | C | 18 | 3.0 | 0.01 | 0.90 | 22 | 1.50 | 7.0 | Tabular grain |
| | D | 17 | 2.0 | 0.03 | 1.10 | 18 | 2.07 | 10.0 | Tabular grain |
| | E | 22 | 2.0 | 0.03 | 0.90 | 22 | 1.50 | 7.0 | Tabular grain |
| | F | 18 | 3.0 | 0.02 | 0.30 | 19 | 0.38 | 3.0 | Tabular grain |
| | G | 17 | 2.0 | 0.02 | 0.50 | 19 | 0.70 | 4.2 | Tabular grain |
| | H | 18 | 1.0 | 0.02 | 0.60 | 17 | 1.00 | 7.0 | Tabular grain |
| | I | 16 | 3.0 | 0.02 | 0.78 | 15 | 1.30 | 7.0 | Tabular grain |
| | J | 19 | 3.0 | 0.02 | 0.97 | 18 | 1.88 | 11.0 | Tabular grain |
| | K | 18 | 4.0 | 0.02 | 0.40 | 16 | 0.55 | 4.0 | Tabular grain |
| | L | 22 | 4.0 | 0.03 | 0.60 | 18 | 1.05 | 8.0 | Tabular grain |
| | M | 20 | 5.0 | 0.02 | 0.80 | 19 | 1.34 | 7.0 | Tabular grain |
| | N | 22 | 6.0 | 0.04 | 1.40 | 24 | 2.80 | 12.0 | Tabular grain |
| | P | — | 1.0 | 0 | 0.07 | — | 0.07 | 1.0 | Homogeneous structure |

In Table 1, (2) Emulsions A to N were subjected to the optimum gold sensitization, sulfur sensitization and selenium sensitization as described in Example 6 of JP-A-10-221827.

(3) The principal planes of the tabular grains consisted of (111) faces, and the tabular grains were prepared by altering addition condition, additive amount, etc. from those of Example 4 of JP-A-10-221827. Added spectral sensitizing dyes conformed to those compounds described with respect to the relevant lightsensitive layers.

(4) In the tabular grains, dislocation lines as described in EP No. 443,453A were observed through a high-voltage electron microscope.

Preparation of dispersions of organic solid disperse dyes:

ExF-2 was dispersed by the following method. Specifically, 21.7 mL (milliliters) of water, 3 mL of a 5% aqueous solution of sodium p-octylphenoxyethoxyethoxyethanesulfonate and 0.5 g of a 5% aqueous solution of p-octylphenoxypolyoxyethylene ether (polymerization degree: 10) were placed in a 700-mL pot mill, and 5.0 g of the dye ExF-2 and 500 mL of zirconium oxide beads (diameter 1 mm) were added thereto. The contents were dispersed for 2 hr. This dispersion was conducted by the use of BO type oscillating ball mill manufactured by Chuo Koki K.K. Thereafter, the contents were taken out from the mill and added to 8 g of a 12.5% aqueous solution of gelatin. The beads were removed by filtration, thereby obtaining a gelatin dispersion of the dye. The average diameter of the dye fine grains was 0.44 $\mu$m.

Solid dispersion of ExF-4 was obtained in the same manner. The average diameter of the dye fine grains was 0.45 $\mu$m.

The compounds employed in the formation of the above individual layers are as follows.

ExC-1

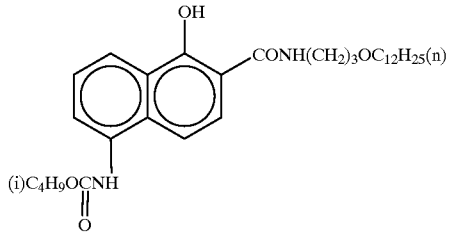

ExC-2

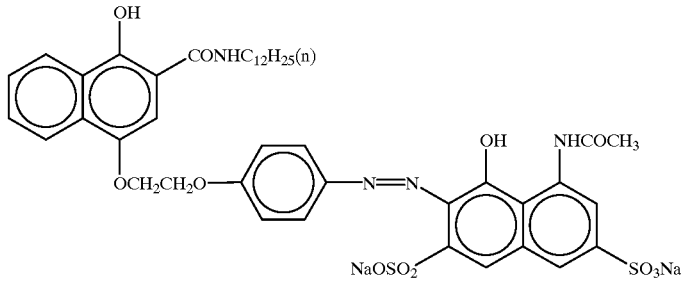

ExC-3

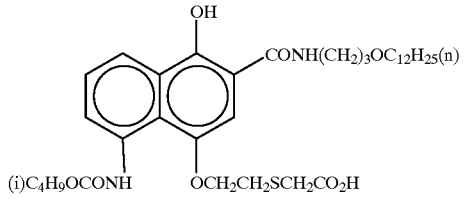

ExC-4

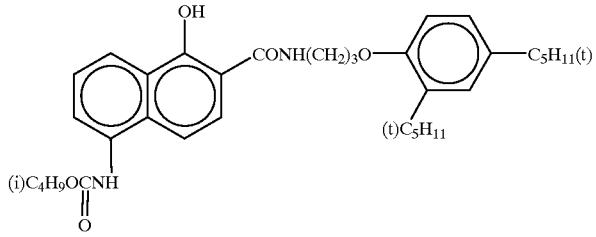

-continued
ExC-5
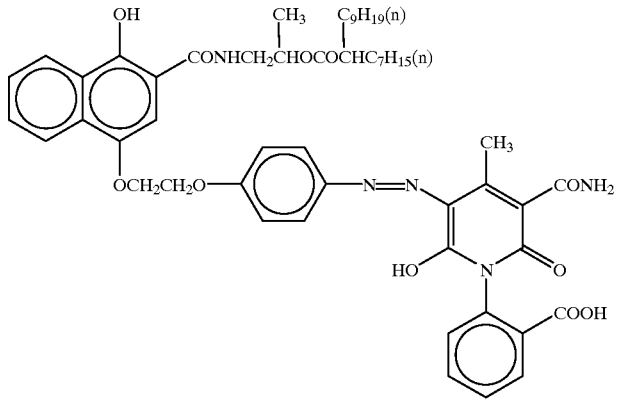
ExC-6
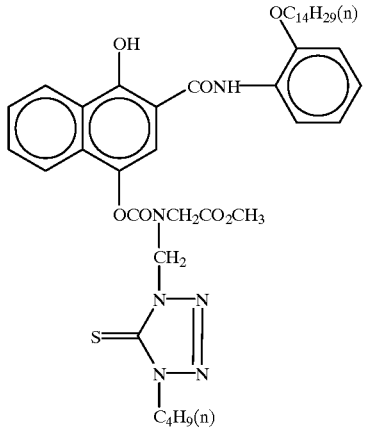
ExC-7
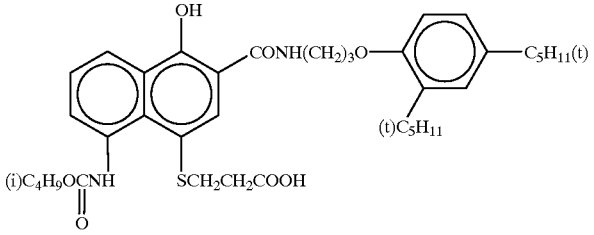

-continued
ExC-8
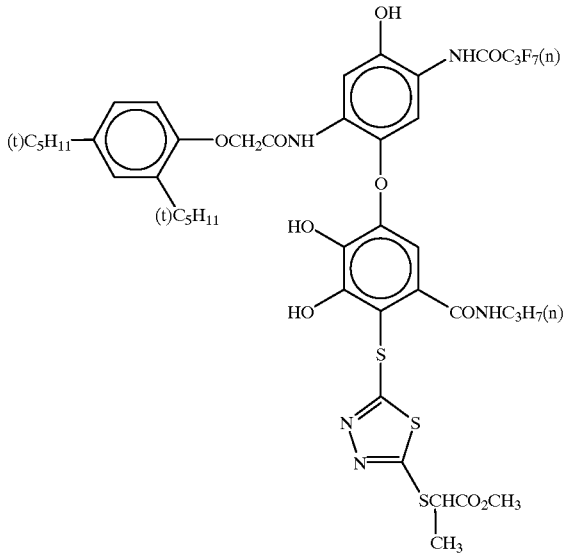
ExM-1
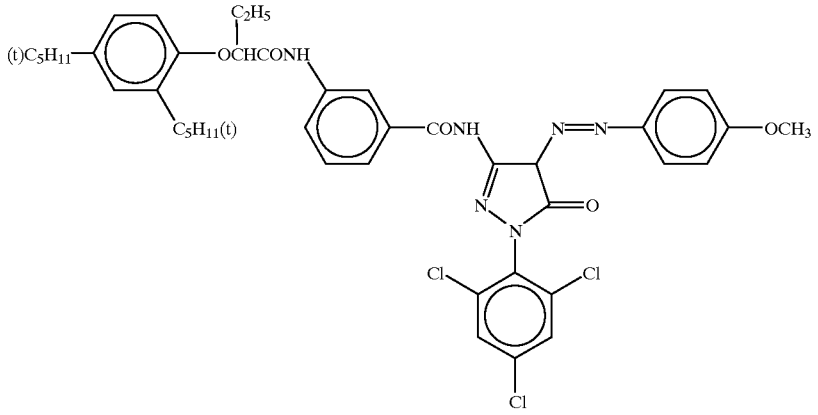
ExM-2
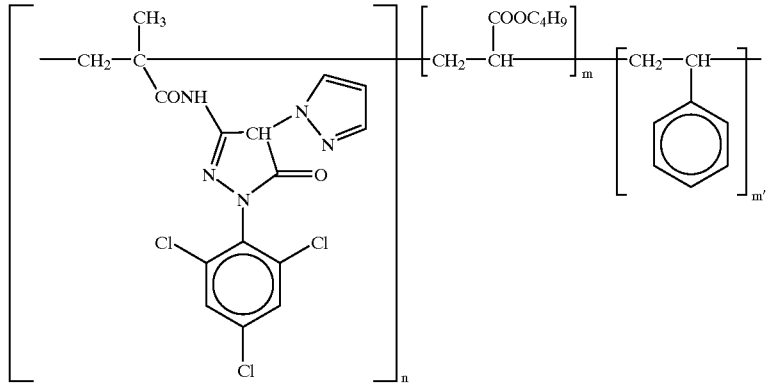
n=50
m=25
m'=25
mol. wt. about 20,000

-continued
ExM-3
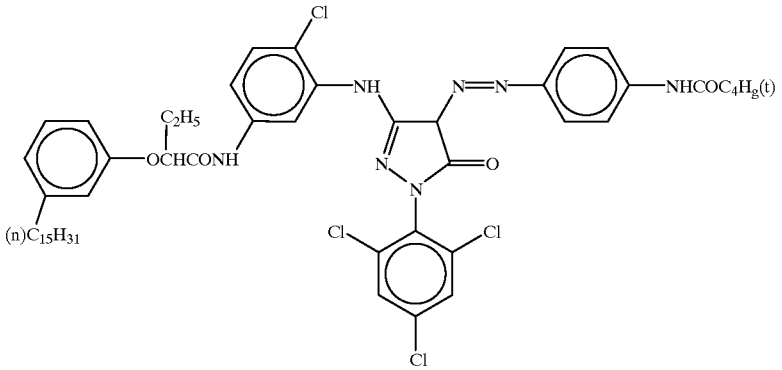
ExM-4
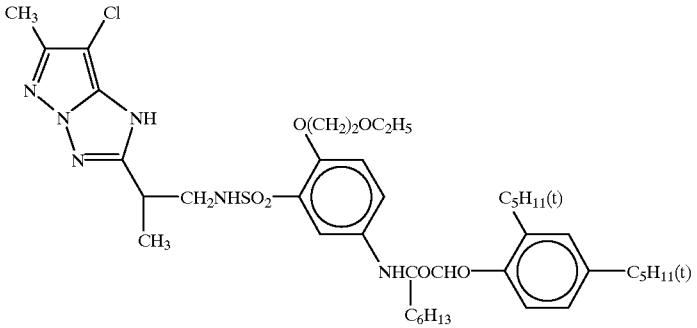
ExM-5
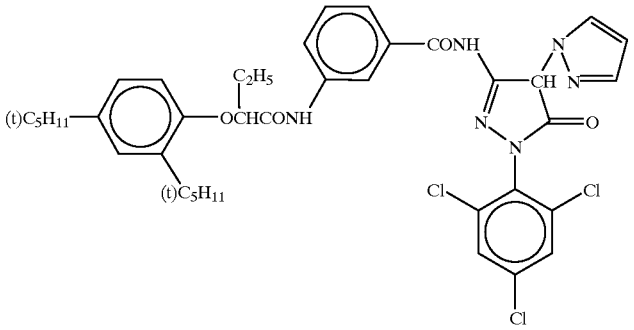
ExY-1
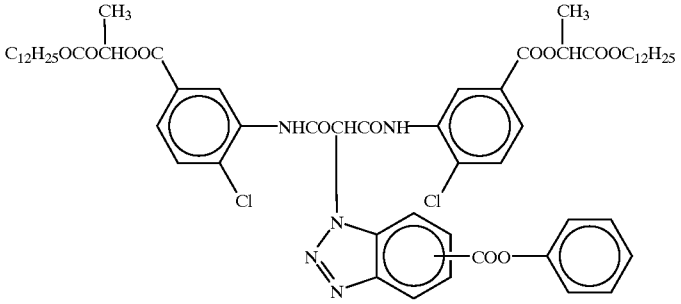

-continued
ExY-2
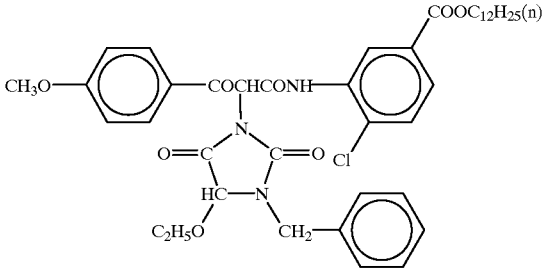
ExY-3
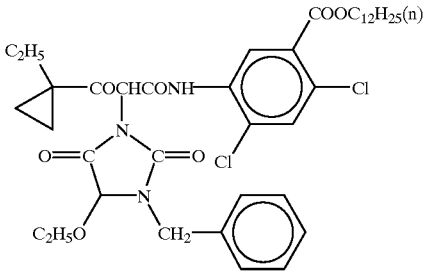
ExY-4
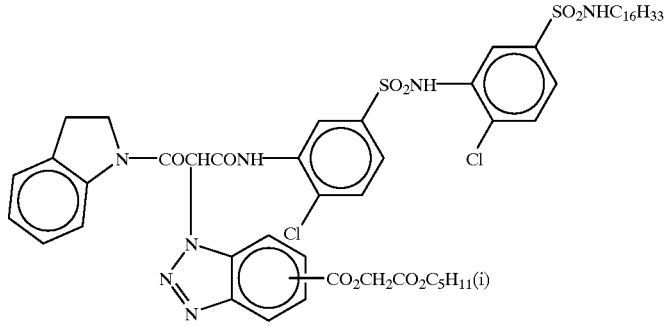
ExY-5
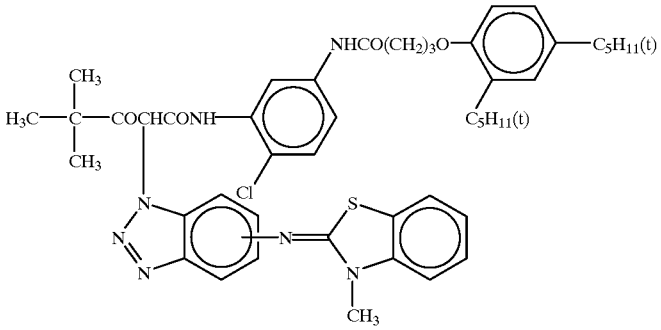
ExY-6
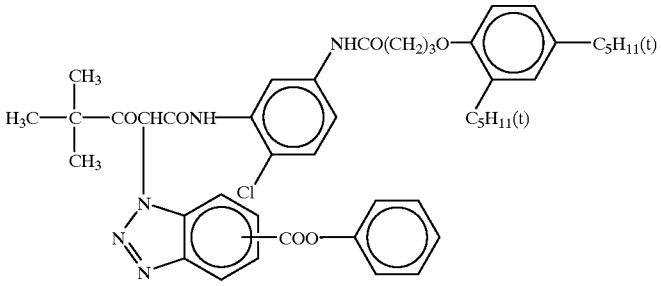

-continued
ExF-1
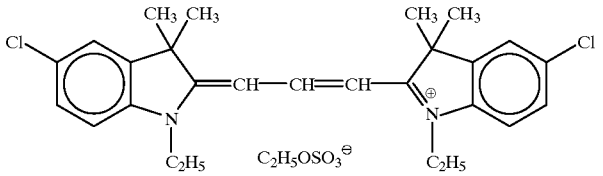
ExF-2
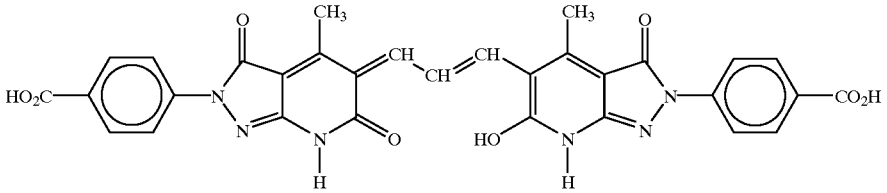
ExF-4
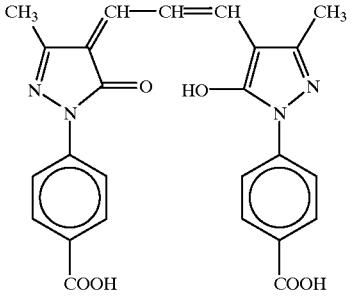
Cpd-1
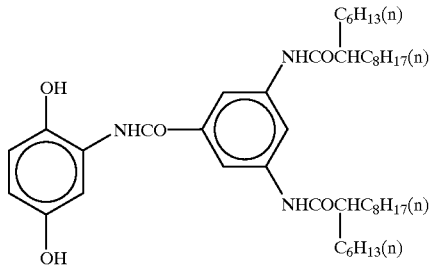
Cpd-2
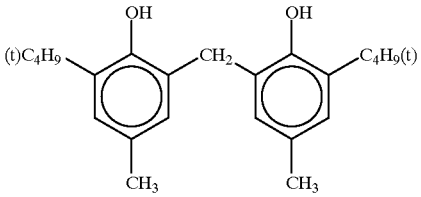
Cpd-3
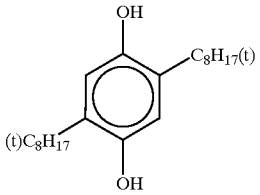
Cpd-4
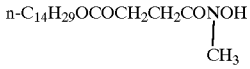

-continued
UV-1
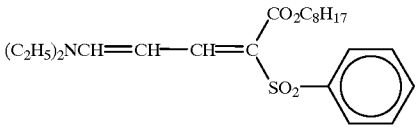
UV-2
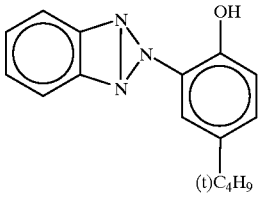
UV-3
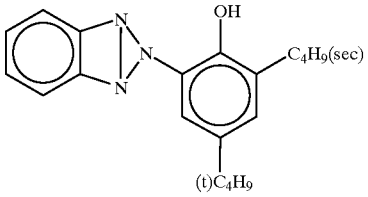
UV-4
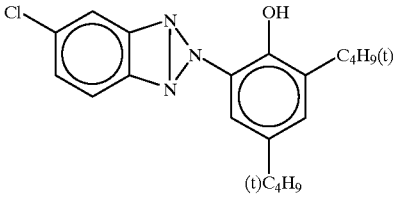
HBS-1
Tricresyl phosphate
HBS-2
Di-n-butyl phthalate
HBS-3
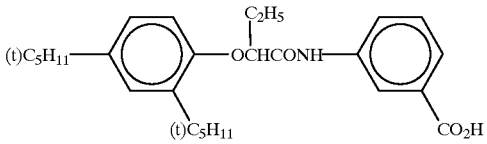
HBS-4
Tri (2-ethylhexyl)phosphate
ExS-1
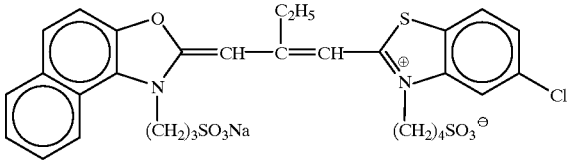
ExS-2
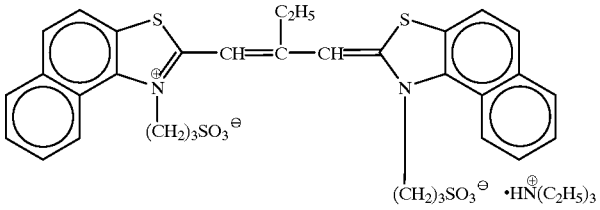

-continued
ExS-3
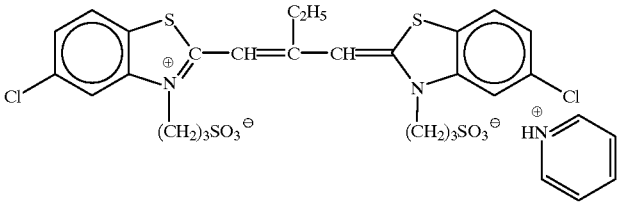
ExS-4
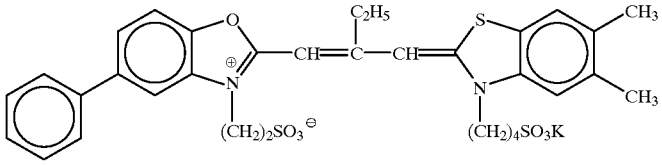
ExS-5
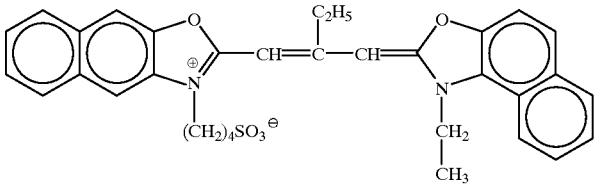
ExS-6
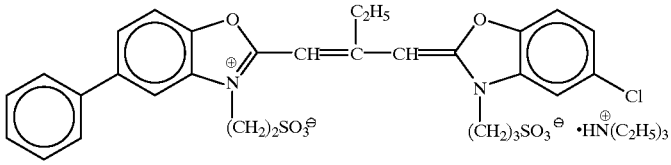
ExS-7
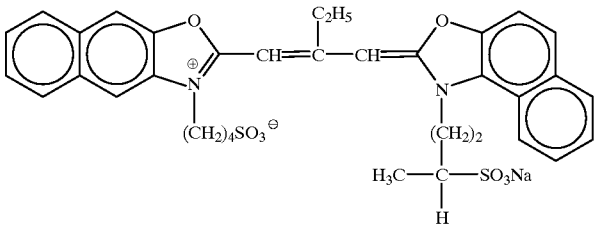
ExS-8
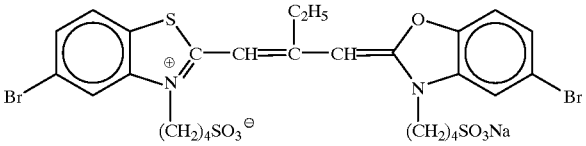
ExS-9
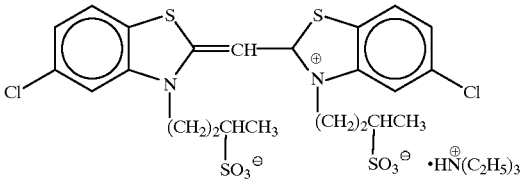

-continued
ExS-10
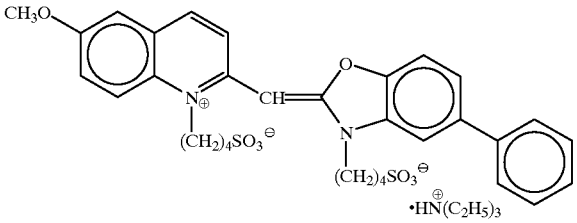
S-1
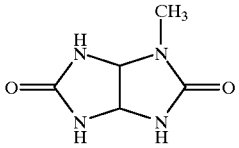
ExS-11
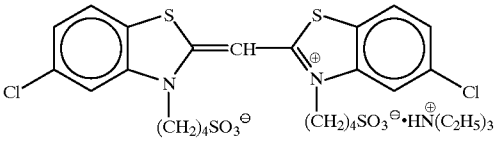
ExS-12
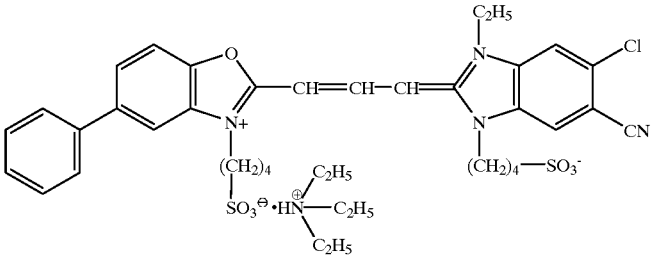
ExS-13
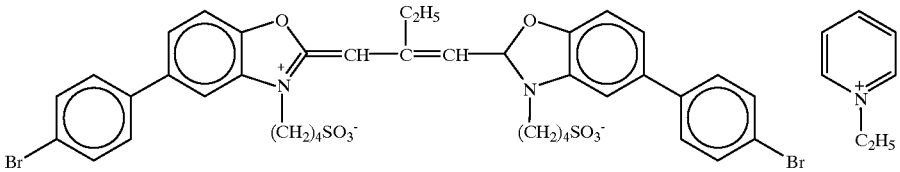
ExS-14
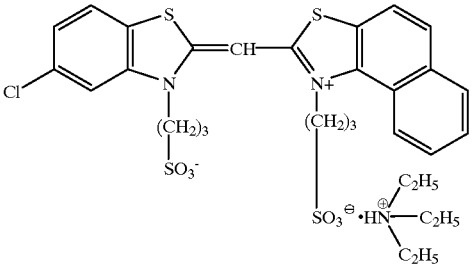
H-1
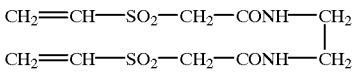
B-1
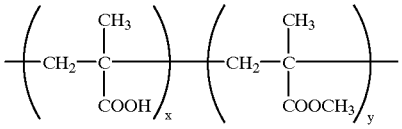
x/y = 10/90(weight ratio)
av. mol. wt. about: 35,000

-continued
B-2
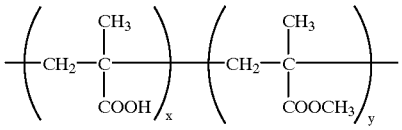
x/y = 40/60(weight ratio)
av. mol. wt. about: 20,000
B-3
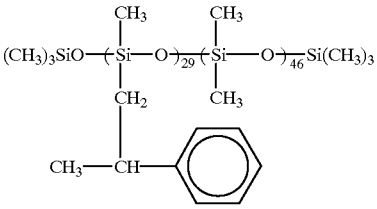
(mol ratio)
av. mol. wt. about: 8,000
B-4
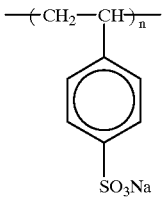
av. mol. wt. about: 750,000
B-5
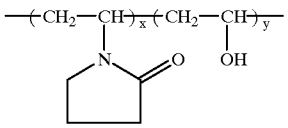
x/y = 70/30(weight ratio)
av. mol. wt. about: 17,000
B-6
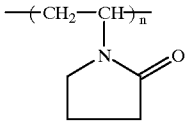
av. mol. wt. about: 10,000
W-1
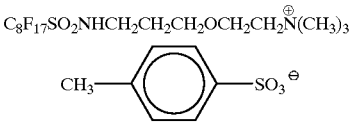
W-2
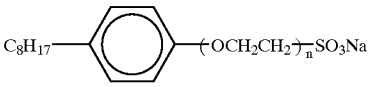
n = 2–4
W-3
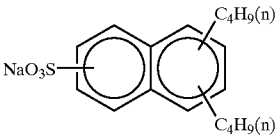

-continued
W-4
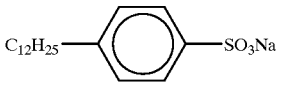
W-5
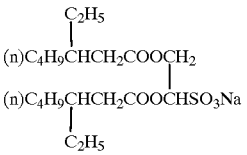
F-1
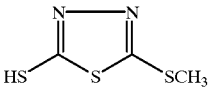
F-2
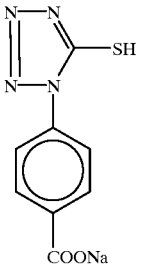
F-3
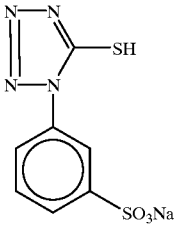
F-4
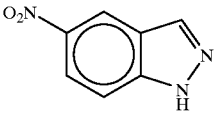
F-5
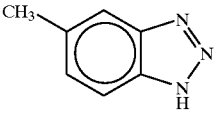
F-6
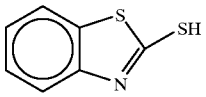
F-7
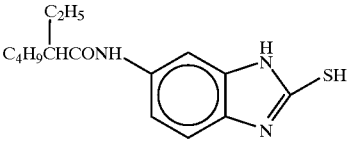

-continued
F-8
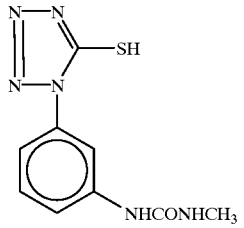
F-9
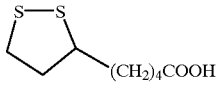
F-10
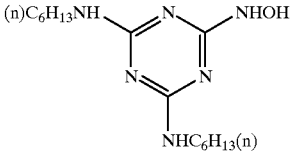
F-11
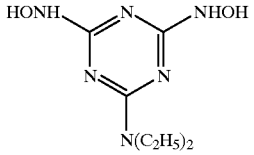
F-12
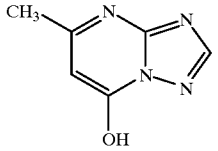
F-13
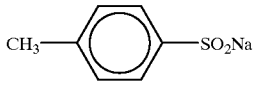
F-14
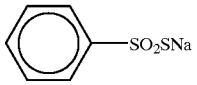

-continued

F-15

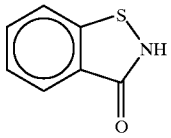

F-16

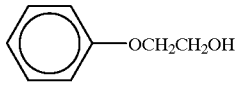

F-17

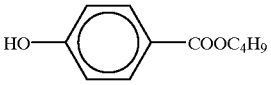

F-18

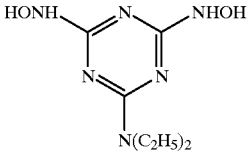

F-19

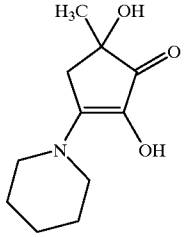

Subsequently, sample 102 was prepared in the same manner as the sample 101, except that the magenta colored yellow coupler (1) set forth above as an example of the compound represented by formula (I) of the present invention was added to the 13th and 14th layers of the sample 101 in an amount of 0.040 g/m$^2$ and that the addition amount of ExY-2 and ExY-3 was reduced as much as the increment of the yellow color density.

Further, samples 103 to 106 were prepared in exactly the same manner as the sample 102, except that the compound added to the 13th and 14th layers of the sample 102 was replaced by an equimolar amount of compounds indicated in Table 2 and that the same correction as in the preparation of the sample 102 was effected.

Still further, sample 107 was prepared in exactly the same manner as the sample 101, except that comparative DIR coupler A was added to the 13th and 14th layers of the sample 101 in the same molar amount as that of the compound (1) of the sample 102.

Comparative DIR-A (Compound T-1 of JP-A-2-230139)

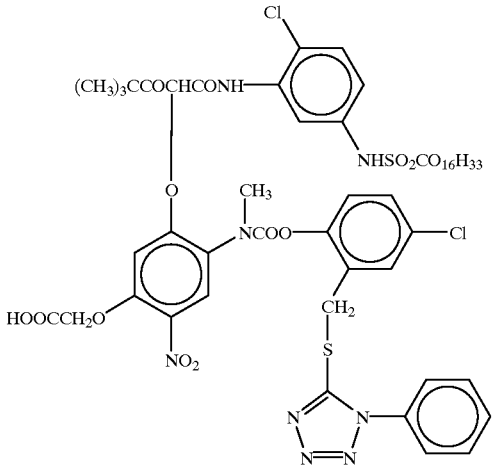

Comparative DIR-A (Compd. T-1 of JP-A-2-230139)

(Evaluation of Sample)

1) Sharpness

Pattern for MTF measurement was printed in the above samples 101 to 107 by white light exposure, and the below described color development was carried out. Results of measurement performed with the use of G filter are given in Table 2.

TABLE 2

| Sample | Compound added to 13th and 14th layers | Sharpness (G) (30 cycles/mm) | Color reproduction (color turbidity) | Remark |
|---|---|---|---|---|
| 101 | — | 0.64 | 0.19 | Comparative Example |
| 102 | ( 1) | 0.73 | 0.03 | Invention |
| 103 | ( 5) | 0.72 | 0.05 | Invention |
| 104 | (12) | 0.70 | 0.06 | Invention |
| 105 | (35) | 0.71 | 0.06 | Invention |
| 106 | (47) | 0.71 | 0.07 | Invention |
| 107 | Comparative DIR A | 0.66 | 0.10 | Comparative Example |

2) Color reproduction

The above samples 101 to 107 were sequentially subjected to a green homogeneous exposure, a blue imagewise exposure and the below described color development. The respective magenta densities at the points of yellow fog density+0.5, yellow fog density+1.0 and yellow fog density+2.0 minus the magenta density at yellow fog density were determined as the respective color turbidities of the above points.

The obtained results are summarized in Table 2. It is seen from the results that the effect of enhancing the sharpness and color reproduction is more conspicuous in the samples in which the magenta colored yellow coupler of the general formula (I) of the present invention was incorporated than in the comparative sample using the DIR coupler.

As apparent from the foregoing, the present invention has enabled realizing excellent sharpness and color reproduction irrespective of rapid processing.

The processing steps and compositions of processing solutions were as follows.

(Processing Steps)

| Step | Time | Temp. | Qty. of replenisher* | Tank vol. |
|---|---|---|---|---|
| Color development | 1 min 30 sec | 41.0° C. | 10 mL | 10.3 L |
| Bleaching | 20 sec | 41° C. | 5 mL | 3.6 L |
| Fixing (1) | 20 sec | 41° C. | — | 3.6 L |
| Fixing (2) | 20 sec | 41° C. | 7.5 mL | 3.6 L |
| Stabilization (1) | 10 sec | 41° C. | — | 1.9 L |
| Stabilization (2) | 10 sec | 41° C. | — | 1.9 L |
| Stabilization (3) | 10 sec | 41° C. | 30 mL | 1.9 L |
| Drying | 30 sec | 60° C. | | |

*The replenishment rate is a value per 1.1 m of a 35-mm wide lightsensitive material (equivalent to one role of 24 Ex. film).

The stabilizer was fed by counter current in the direction of stabilization (3)→stabilization (2)→stabilization (1), and, with respect to the fixer as well, connection was effected by a counter current piping directed from fixing (2) to fixing (1). 15 mL, equivalent to the replenishment rate, of the stabilizer (2) tank solution was caused to flow into the fixer (2). The amounts of drag-in of developer into the bleaching step, drag-in of bleaching solution into the fixing step and drag-in of fixer into the washing step were all 2.0 mL per 1.1 m of a 35-mm wide lightsensitive material. Each crossover time was 6 sec, which was included in the processing time of the previous step.

The composition of each of the processing solutions was as follows.

| (Color developer) | Tank soln. (g) | Replenisher (g) |
|---|---|---|
| Diethylenetriamine-pentaacetic acid | 3.0 | 5.0 |
| Sodium 4,5-dihydroxybenzene-1,3-disulfonate | 0.5 | 0.5 |
| Disodium-N,N-bis(2-sulfonatoethyl)hydroxylamine | 10.0 | 15.0 |
| Sodium sulfite | 4.0 | 10.0 |
| Hydroxylamine sulfate | 1.5 | 3.0 |
| Potassium chloride | 2.0 | — |
| Diethylene glycol | 10.0 | 10.0 |
| Ethyleneurea | 3.0 | 3.0 |
| 2-Methyl-4-[N-ethyl-N-(β-hydroxyethyl)amino]-aniline sulfate | 6.0 | 11.4 |
| Potassium carbonate | 35 | 35 |
| Water | q.s. ad 1.0 L | |
| pH | 10.10 | 10.60 |

This pH was adjusted by the use of sulfuric acid and KOH.

| (Bleaching soln.) | Tank soln. (g) | Replenisher (g) |
|---|---|---|
| Fe(III) ammonium 1,3-diaminopropanetetraacetate monohydrate | 140 | 200 |
| Ammonium bromide | 50 | 70 |
| Succinic acid | 10 | 15 |
| Maleic acid | 40 | 60 |
| Imidazole | 60 | 90 |
| Water | q.s. ad 1.0 L | |
| pH | 4.2 | 3.8 |

This pH was adjusted by the use of aqueous ammonia and nitric acid.

| (Fixer) | Tank soln. (g) | Replenisher (g) |
|---|---|---|
| Ammonium thiosulfate (750 g/L) | 280 mL | 750 mL |
| Aq. soln. of ammonium bisulfite (72%) | 20 | 80 |
| Imidazole | 10 | 45 |
| 3-Mercaptotriazole | 1 | 3 |
| Ethylenediaminetetraacetic acid | 3 | 9 |
| Water | q.s. ad 1.0 L | |
| pH | 7.0 | 7.0 |

This pH was adjusted by the use of aqueous ammonia and acetic acid.

| (Stabilizer): common to tank solution and replenisher. | (g) |
|---|---|
| Sodium p-toluenesulfinate | 0.03 |
| p-Nonylphenoxypolyglycidol (glycidol av. polymn. degree 10) | 0.4 |
| Disodium ethylenediaminetetraacetate | 0.05 |
| 1,2,4-Triazole | 1.3 |
| 1,4-Bis(1,2,4-triazol-1-ylmethyl)-piperazine | 0.75 |
| 1,2-Benzoisothiazolin-3-one | 0.10 |
| Water | q.s. ad 1.0 L |
| pH | 8.5 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic lightsensitive material comprising a support and, superimposed thereon, at least one red-sensitive silver halide emulsion layer, at least one green-sensitive silver halide emulsion layer and at least one blue-sensitive silver halide emulsion layer, wherein each of the at least one red-sensitive emulsion layer, at least one green-sensitive emulsion layer and at least one blue-sensitive emulsion layer contains a silver halide emulsion whose silver chloride content is in the range of 50 to 100 mol %; and at least one layer of the lightsensitive material contains a compound represented by formula (I):

$$Cp—(L)_n—B \quad (I)$$

wherein Cp represents a yellow coupler residue capable of reacting with a developing agent in an oxidized form to thereby release $—(L)_n—B$; L represents a divalent connecting group or timing group; B represents a group required to form magenta image in the form of $Cp—(L)_n—B$ at least after development, while the released $—(L)_n—B$ group substantially does not contribute to any image formation after development; and n is 0 or 1.

2. The silver halide color photographic lightsensitive material according to claim 1, wherein the yellow coupler residue Cp is represented by formula (I-A) or formula (I-B):

(I-A)

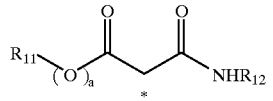

wherein * represents a position at which the yellow coupler residue Cp is bonded to $—(L)_n—B$ of the general formula (I); $R_{11}$ represents an alkyl group, an alkenyl group, an alkynyl group, an aryl group or a heterocyclic group; $R_{12}$ represents a hydrogen atom, an alkyl group, an alkenyl group, an alkynyl group, an aryl group or a heterocyclic group; and a is 0 or 1, (I-B)

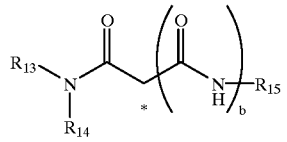

wherein * represents a position at which the yellow coupler residue Cp is bonded to $—(L)_n—B$ of the general formula (I); $R_{13}$ represents an alkyl group, an alkenyl group, an alkynyl group, an aryl group or a heterocyclic group; each of $R_{14}$ and $R_{15}$ independently represents a hydrogen atom, an alkyl group, an alkenyl group, an alkynyl group, an aryl group or a heterocyclic group; and b is 0 or 1.

3. The silver halide color photographic lightsensitive material according to claim 2, wherein Cp that is represented by formula (I-A) is represented by formula (I-C):

(I-C)

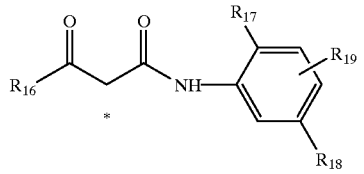

wherein * represents a position at which the yellow coupler residue Cp is bonded to $—(L)_n—B$ of the general formula (I); $R_{16}$ represents a tertiary alkyl group, an aryl group or an indolinyl group; $R_{17}$ represents a halogen atom, an alkoxy group, an aryloxy group or an alkyl group; $R_{18}$ represents an acylamino group, a sulfonamido group, a carbamoyl group, a sulfamoyl group, an alkoxycarbonyl group or a sulfonyl group; and $R_{19}$ represents a hydrogen atom or a substituent.

4. The silver halide color photographic lightsensitive material according to claim 2, wherein a represent 0 and $R_{11}$ represents a substituted or unsubstituted alkyl group having 1 to 32 carbon atoms or a substituted or unsubstituted aryl group having 6 to 40 color atoms.

5. The silver halide color photographic lightsensitive material according to claim 4, wherein $R_{12}$ is an aryl group.

6. The silver halide color photographic lightsensitive material according to claim 1, wherein the yellow coupler residue Cp is selected from the group consisting of pivaloylacetanilido residues, benzoylacetanilido residues, malondiester residues, malondiamido residues, dibenzoylmethane residues, benzothiazolylacetamido residues, malonestermonoamido residues, benzoxazolylacetamido residues, benzoylimidazolylacetamido residues, cycloalkanoylacetamido residues, indolin-2-ylacetamido residues, and quinazolin-4-on-2-ylacetamido residues.

7. The silver halide color photographic lightsensitive material according to claim 2, wherein the alkyl group represented by $R_{11}$ is a substituted or unsubstituted alkyl group having 1 to 32 carbon atoms; the alkenyl or alkynyl group represented by $R_{11}$ is a substituted or unsubstituted alkenyl or alkynyl group having 2 to 32 carbon atoms; the aryl group represented by $R_{11}$ is a substituted or unsubstituted aryl group having 6 to 40 carbon atoms; the heterocyclic group represented by $R_{11}$ is a substituted or unsubstituted 3- to 8-membered heterocyclic group, whose hetero atom is selected from the group consisting of nitrogen atom, oxygen atom and sulfur atom and having 1 to 40 carbon atoms, to which an aromatic carbon ring may be condensed.

8. The silver halide color photographic lightsensitive material according to claim 2, wherein the alkyl group represented by $R_{11}$ is selected from the group consisting of methyl, ethyl, propyl, isopropyl, butyl, isobutyl, t-butyl, t-amyl, hexyl, cyclohexyl, 2-ethylhexyl, octyl, 1,1,3,3-tetramethylbutyl, decyl, dodecyl, hexadecyl and octadecyl; the alkenyl or alkynyl group represented by $R_{11}$ is selected from the group consisting of vinyl, 2-propenyl, ethynyl and 2-propynyl; the aryl group represented by $R_{11}$ selected from the group consisting of phenyl, tolyl and naphthyl; and the heterocyclic group represented by $R_{11}$ is selected from the group consisting of 2-furyl, 2-pyrrolyl, 2-thienyl, 3-tetrahydrofuranyl, 4-pyridyl, 2-pyrimidinyl, 2-(1,3,4-thiadiazolyl), 2-benzothiazolyl, 2-benzoxazolyl, 2-benzimidazolyl, 2-benzoselenazolyl, 2-quinolyl, 2-oxazolyl, 2-thiazolyl, 2-selenazolyl, 5-tetrazolyl, 2-(1,3,4-oxadiazolyl) and 2-imidazolyl.

9. The silver halide color photographic lightsensitive material according to claim 2, wherein a is 1 and $R_{11}$ is an alkyl group.

10. The silver halide color photographic lightsensitive material according to claim 2, wherein b is 0; $R_{15}$ is a heterocyclic group; $R_{13}$ is an aryl group; and $R_{14}$ is a hydrogen atom.

11. The silver halide color photographic lightsensitive material according to claim 2, wherein b is 1; $R_{15}$ and $R_{13}$ are each an aryl group; and $R_{14}$ is an alkyl group an alkenyl group or a hydrogen atom.

12. The silver halide color photographic lightsensitive material according to claim 3, wherein $R_{16}$ represents an acyclic tertiary alkyl selected from the group consisting of t-butyl, 1,1-dimethylpropyl, 1,1-dimethylhexyl, 1,1-dimethyl-2-methoxyethyl and 1,1-dimethyl-2-phenylethyl; a cycloalkyl group selected from the group consisting of 1-methylcyclopropyl, 1-ethylcyclopropyl, 1-benzylcyclopropyl, 1-methylcyclobutyl, 1-methylcyclopentyl, 1-ethylcyclopentyl, 1-methylcyclohexyl, 5-methyl-1,3-dioxan-5-yl, 2,2,5-trimethyl-1,3-dioxan-5-yl and 1-adamantyl; an aryl group selected from the group consisting of phenyl, 2-methylphenyl, 4-methoxyphenyl, 4-hexadecyloxyphenyl, 3-chlorophenyl, 3,5-dimethylphenyl and 2-naphthyl or an substituted or unsubstituted indolinyl group selected from the group consisting of indolinyl, 2-methylindolinyl, 5-chloroindolinyl and 5-cyanoindolinyl;

$R_{17}$ represents a halogen atom selected from the group consisting of a fluorine atom, a bromine atom and a chlorine atom); an alkoxy group selected from the group consisting of methoxy, ethoxy, butoxy, octyloxy, cyclohexyloxy, n-dodecyloxy, n-hexadecyloxy and methoxyehtoxy; an aryloxy group selected from the group consisting of phenoxy, 4-methylphenoxy, 4-methoxyphenoxy, 2-chlorophenoxy and 1-naphthyloxy or an alkyl group selected from the group consisting of methyl, butyl, isopropyl and t-butyl;

$R_{18}$ represents an acylamino group selected from the group consisting of acetylamino, benzoylamino, stearoylamino, N-methylstearoylamino and 2-(2,4-di-t-amylphenoxy)butyrylamino; a sulfonamido group selected from the group consisting of methanesulfonamido, butanesulfonamido, dodecanesulfonamido, hexadecanesulfonamido and benzenesulfonamido; a carbamoyl group selected from the group consisting of N,N-diethylcarbamoyl, N,N-dioctylcarbamoyl, N-methyl-N-hexadecylcarbamoyl and N-phenyl-N-dodecylcarbamoyl; a sulfamoyl group selected from the group consisting of N,N-diethylsulfamoyl, N,N-dioctylsulfamoyl, N-methyl-N-hexadecylsulfamoyl and N-phenyl-N-dodecylsulfamoyl; an alkoxycarbonyl group selected from the group consisting of methoxycarbonyl and dodecyloxycarbonyl or a sulfonyl group selected from the group consisting of methanesulfonyl, dodecanesulfonyl and octadecanesulfonyl; and $R_{19}$ represents a hydrogen atom or a substituent.

* * * * *